United States Patent [19]

Shannon et al.

[11] 3,991,911

[45] Nov. 16, 1976

[54] AUTOMATIC DRINK DISPENSING APPARATUS HAVING PROGRAMMING MEANS

[75] Inventors: Joseph W. Shannon, Kent; Clarence A. Ripley, Jr., Tallmadge; John Henry Dailey, Ravenna, all of Ohio

[73] Assignee: American Beverage Control, Kent, Ohio

[22] Filed: Sept. 7, 1973

[21] Appl. No.: 395,125

[52] U.S. Cl. ..... 222/25; 222/70; 222/76; 222/129.4; 222/144.5; 222/373; 222/479

[51] Int. Cl.[2] ..... B67D 5/06

[58] Field of Search ..... 222/144.5, 148, 25, 222/76, 108, 129.4, 56, 394, 70, 23, 373, 146 C, 479, 25; 138/111, 112, 114, 30; 239/549, 423; 313/272, 343; 340/378, 340, 335

[56] References Cited

UNITED STATES PATENTS

| | | | |
|---|---|---|---|
| 2,814,749 | 11/1957 | Falge | 313/272 X |
| 2,960,060 | 11/1960 | Chatterton | 222/108 X |
| 3,120,326 | 2/1964 | Hedeman | 222/148 X |
| 3,162,323 | 12/1964 | Kromer | 222/146 C X |
| 3,164,299 | 1/1965 | Kenney | 222/129.4 X |
| 3,227,367 | 1/1966 | Coja | 235/146 |
| 3,353,560 | 11/1967 | McCulloch | 138/30 |
| 3,409,176 | 11/1968 | Krause | 222/129.4 X |
| 3,428,218 | 2/1969 | Coja | 222/76 X |
| 3,498,502 | 3/1970 | Breitenstein et al. | 222/148 X |
| 3,500,455 | 3/1970 | Ross et al. | 340/335 X |
| 3,580,421 | 5/1971 | Bickford | 222/27 |
| 3,642,174 | 2/1972 | Cornelius | 222/146 C X |
| 3,664,550 | 5/1972 | Carothers et al. | 222/144.5 X |
| 3,664,552 | 5/1972 | Carse | 222/144.5 |
| 3,675,820 | 7/1972 | Newberry et al. | 222/76 |
| 3,695,314 | 10/1972 | Watts et al. | 222/144.5 X |
| 3,777,937 | 12/1973 | Buck | 222/129.4 X |

*Primary Examiner*—Stanley H. Tollberg
*Assistant Examiner*—John P. Shannon
*Attorney, Agent, or Firm*—Oldham & Oldham Co.

[57] ABSTRACT

An automatic drink dispensing apparatus wherein drinks are poured to prescribed formulations following proper operation of "selected" buttons on a keyboard console. The ingredients of the drink are simultaneously poured so that the length of pour is determined by the length of time that it takes to pour the major ingredient so as to produce extreme speed in dispensing drinks and thus raising the gross operation.

Finally, solid state electronic means in the form of semi-conductor "logic gates" are provided and arranged in a unique fashion to permit the apparatus to perform the above-noted improvements.

55 Claims, 47 Drawing Figures

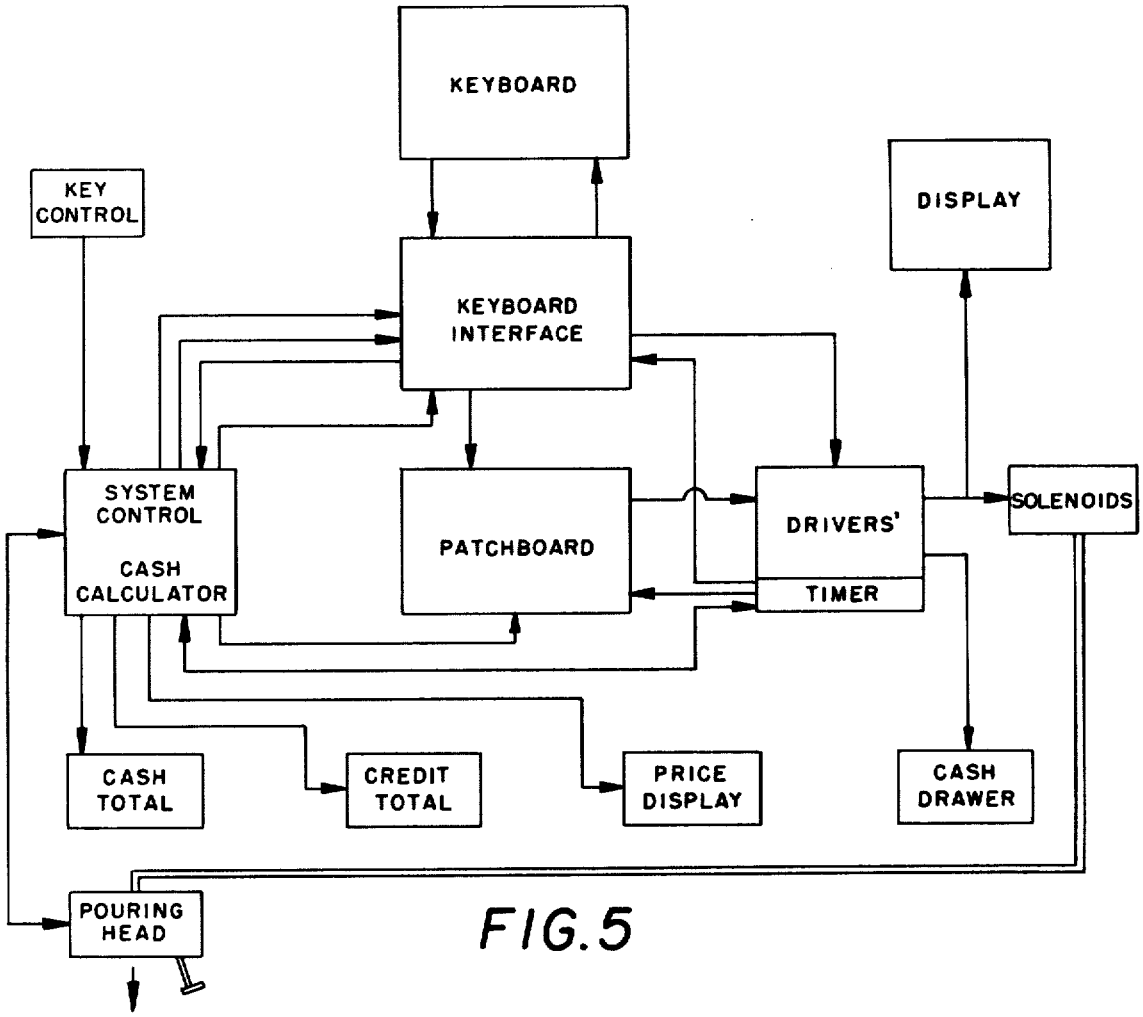

FIG. 5

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | HOUSE BLEND | HOUSE BOURBON | SCOTCH | GIN | SD | RUM | BRANDY | | CORDIAL | | | | | | | |
| 2 | BLEND | BOURBON | SCOTCH | GIN | SD | RUM | BRANDY | | CORDIAL | | | | | | | |
| 3 | BLEND | BOURBON | SCOTCH | GIN | SD | RUM | BRANDY | | CORDIAL | | | | | | | |
| 4 | BLEND | BOURBON | SCOTCH | VODKA | SD | CORDIAL | CORDIAL | | CORDIAL | | | | | | | |
| 5 | BLEND | BOURBON | SCOTCH | VODKA | SD | CORDIAL | CORDIAL | | CORDIAL | | | | | | | |
| 6 | BLEND | BOURBON | SCOTCH | SD | SD | SD | CORDIAL | | CORDIAL | | | | | | | |
| 7 | ROCKS | COLLINS | SOUR | MARTINI / DRY MANHATTAN | MANHATTAN | SD | SPLASH | REPEAT | TOTAL DRAWER | TOTAL CREDIT | | | | PRIME | WASH | CLEAR |

FIG. 6

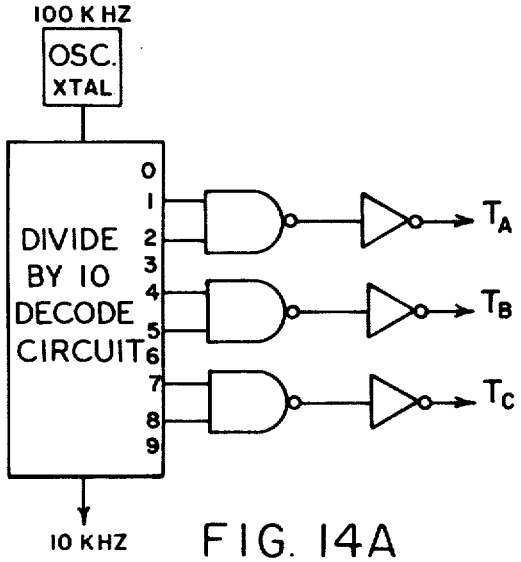
FIG. 14A
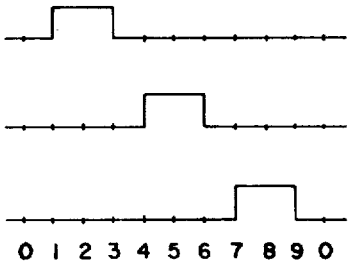
FIG. 14B
FIG. 15
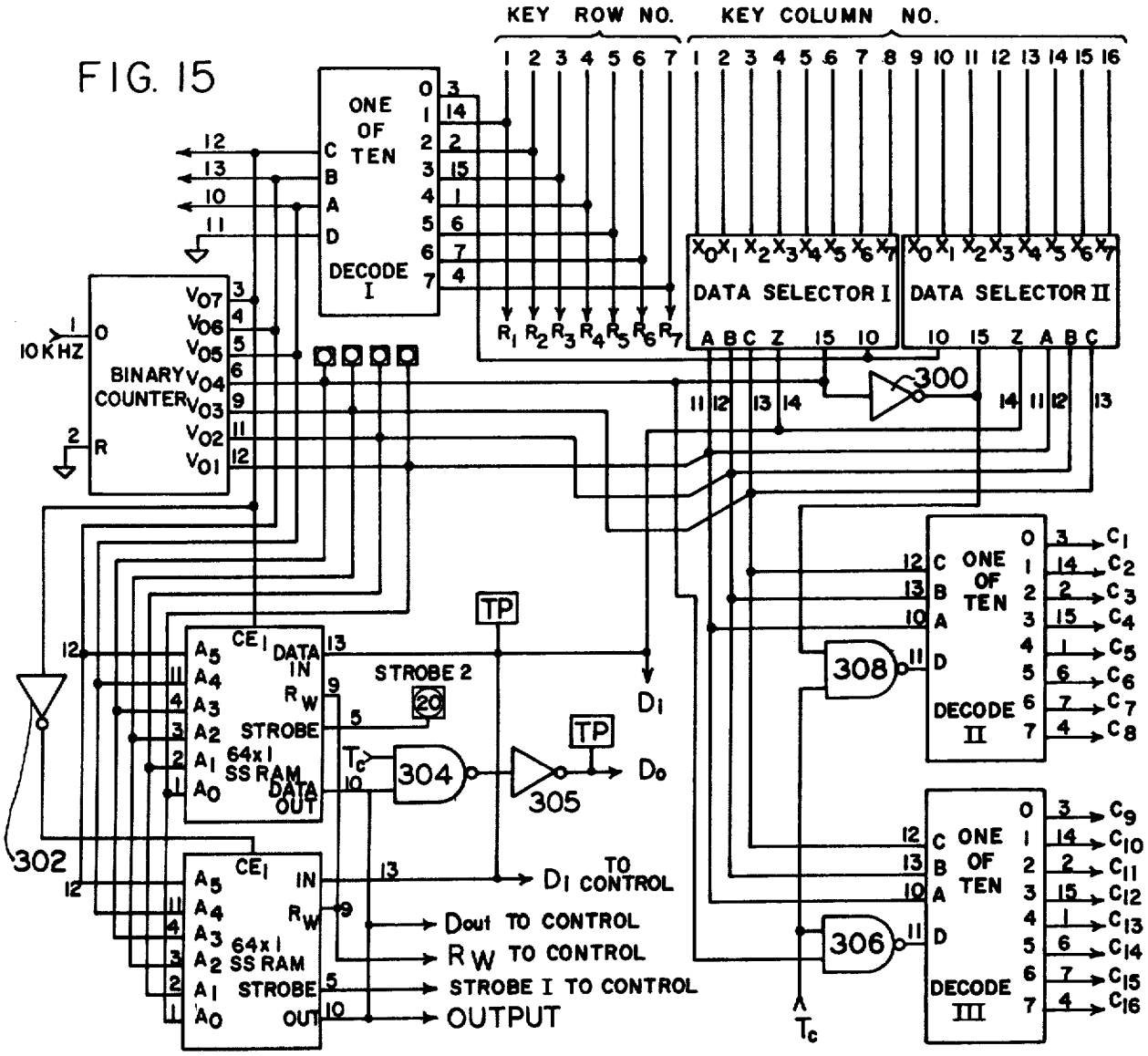

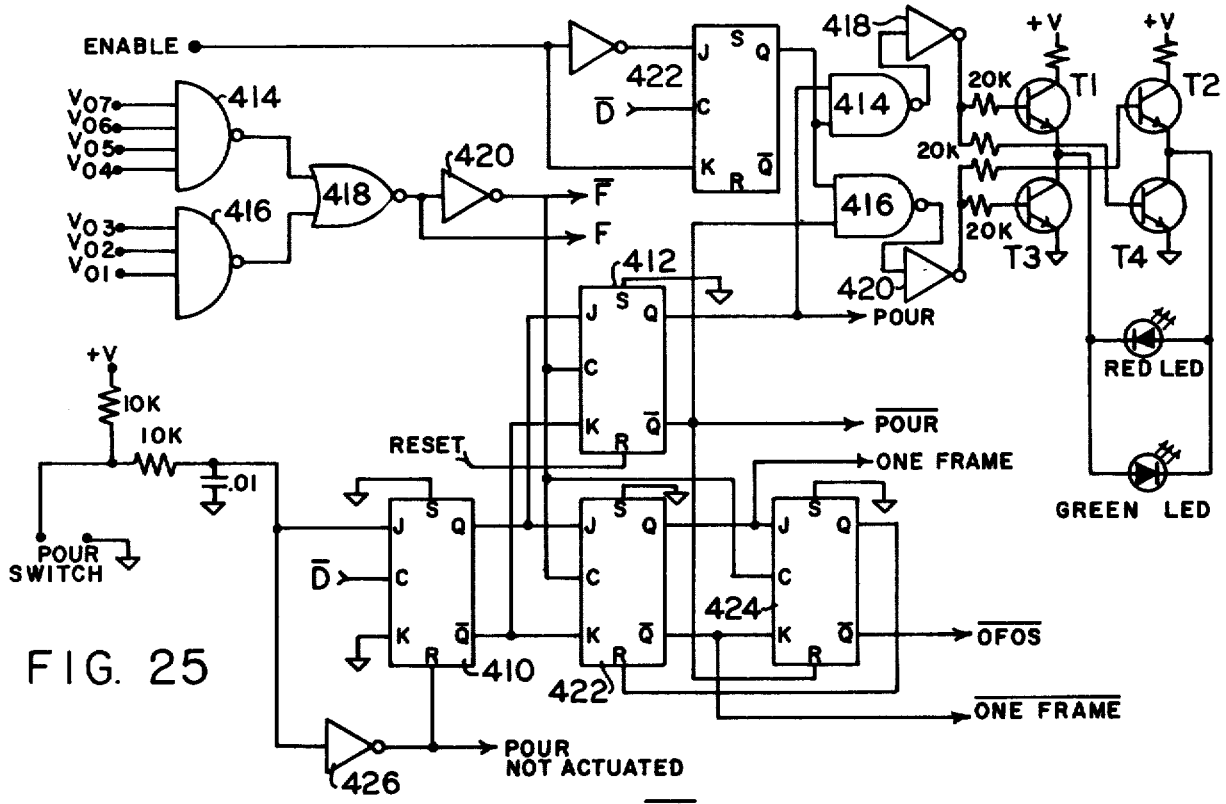
FIG. 25
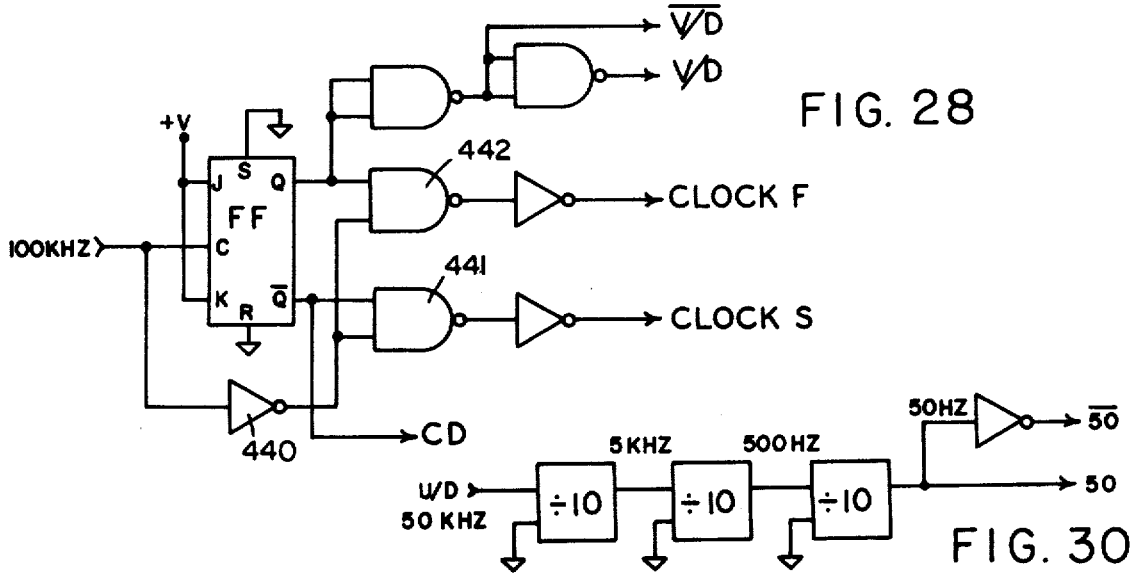
FIG. 28
FIG. 30
FIG. 33
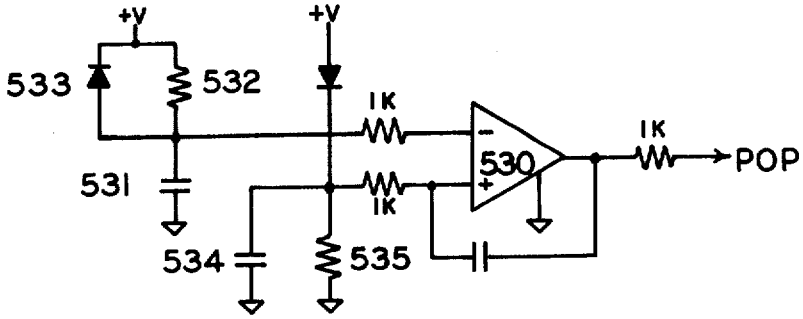

AUTOMATIC DRINK DISPENSING APPARATUS HAVING PROGRAMMING MEANS

BACKGROUND OF THE INVENTION

A. Field of the Invention

This invention relates to the art of automatically dispensing beverages and, in particular, relates to the art of accurately dispensing alcoholic beverages, either alone as in the case of a single shot or as in ingredient of a mixed drink such as a high ball or cocktail.

Dispensing of alcoholic beverages has always entailed problems that are peculiar to this industry, with the particular problems being consistency, accounting, accuracy, control, speed, and compliance with state laws and other federal legislation.

In regards to accuracy, it is well known that there is an inconsistency of pour between various bartenders even though a measuring or shot glass is frequently employed for the purpose of making the mixed drink in question.

In some instances less than full measure of alcohol is given either intentionally or by accident, while in other instances more than the correct measure is inserted with the result that there is often a "shift-to-shift" inconsistency of any given drink in a particular establishment. It is well known in the industry that "overpour" exists in almost all instances of mixing drinks in a shaker. The person mixing the drinks want to avoid the possibility of coming up "short" when the drink is poured, and thus the tendency is to err by overpouring the necessary ingredients into the shaker.

As regards to theft and pilferage, there is often times an unintentional or intentional, as the case may be, failure to charge for a drink, with the result that the owner of the establishment in question fails to receive the full return on the alcoholic beverages that are being dispensed.

As to state and federal regulations, the same generally require that the product being dispensed be displayed at the point of sale.

In other systems that will be discussed subsequently in connection with the discussion of the prior art, there have been employed pressurized systems which serve to move the alcohol from the larger back-up container for the same to the bottle that is displayed at the point of sale.

In addition to requiring expensive and complex fittings to accomplish such movement, such systems have an inherent danger of explosion and/or implosion as the case may be depending upon whether a pressure or vacuum system is being employed for this purpose.

Further in this regard and in order to meet the aforementioned requirement, federal legislation prohibits the use of pressurized containers unless the same are properly identified, with the result that special fittings and elaborate mechanisms have been designed to pour the alcohol under pressure while still meeting the identification requirement aforementioned.

Another problem prevalent in the sale of alcoholic beverages is the question of inventory control, with inaccuracies and theft and pilferage problems aforementioned making accurate inventory control difficult, if not impossible.

B. DESCRIPTION OF THE PRIOR ART

Several attempts have been made in the past to solve the problems above-noted, and while some of the references have solved some of the problems, no complete solution to the overall problem is presented at the present time.

In this regard some of the prior art requires "sequential" pouring, which means that each ingredient must be individually poured followed by the pouring of the next ingredient until a complete drink has been formulated. Applicant contemplates, on the other hand, using a "parallel" type of system wherein drinks are dispensed simultaneously.

Others have a limited menu of drinks that can be poured, while still others are complex and difficult to adjust and, for the most part, inflexible once they have been adjusted.

Finally, substantially all the references that will hereinafter be discussed require pressurization of some type in order for proper operation.

The following patents are believed pertinent:

| | |
|---|---|
| Coja | U.S. Pat. No. 3,428,218 |
| Coja | U.S. Pat. No. 3,227,367 |
| Coja | U.S. Pat. No. 3,305,132 |
| Arps et al | U.S. Pat. No. 3,386,621 |
| Arps et al | U.S. Pat. No. 3,341,073 |
| Krause | U.S. Pat. No. 3,409,176 |
| Newberry et al | U.S. Pat. No. 3,675,820 |

The following patents are believed to be of general interest as to certain features of the application as will hereinafter be described:

| | |
|---|---|
| Chatterton | U.S. Pat. No. 2,960,060 |
| Reynolds et al | U.S. Pat. No. 2,961,127 |
| Keller et al | U.S. Pat. No. 3,112,844 |
| Bayers, Jr. | U.S. Pat. No. 3,119,485 |
| Whitney | U.S. Pat. No. 3,124,645 |
| Cornelius | U.S. Pat. No. 3,216,445 |
| Cardillo | U.S. Pat. No. 3,341,078 |
| Young | U.S. Pat. No. 3,511,468 |
| Woollen | U.S. Pat. No. 3,590,855 |
| Carse | U.S. Pat. No. 3,664,552 |
| Erne et al | U.S. Pat. No. 3,685,692 |
| Reichenberger | U.S. Pat. No. 3,688,947 |
| Booth | U.S. Pat. No. 3,703,187 |

SUMMARY OF THE INVENTION

It is a principal object of the invention to provide an automatic drink dispensing apparatus that can be preprogrammed to the point where drinks will be automatically poured to pre-prescribed formulations after drink selection has been achieved on the keyboard followed by activation of the apparatus.

It is a further object of the invention to provide a keyboard console wherein some selective switches can be operated to dispense different amounts of the same ingredient dependent upon the drink selected.

It is a further object of the invention to provide a drink dispensing apparatus that is capable of dispensing, either singly or in admixed relationship, liquids that come from a plurality of sources and which are mixed together at a common pour point, with the drinks in question including liquids delivered to the pour head under either (1) the force of gravity, (2) the force of compressed air, (3) source pressure such as water, (4) carbonation pressure, or (5) a combination of the foregoing. During this discharge it is to be noted that the liquids never intermingle with each other and, further, are not exposed to a common surface until they are actually in the atmosphere between the pour head and the receptacle into which they are being dispensed.

It is a still further object of this invention to provide a drink dispensing apparatus that includes display apparatus for displaying not only the ingredients being poured, but also accumulating and totaling the price thereof both at the point of sale and at a remote location.

It is a further object of the invention to provide a drink dispensing apparatus wherein the alcohol is dispensed from the original container by the force of gravity rather than by the use of pressurized air.

It is a further object of the invention to provide a drink dispensing apparatus wherein the operator is apprised, after punching the appropriate selected button on the apparatus keyboard, of the size or shape glass that is to be positioned under the pour head prior to activating the unit.

It is a further object of this invention to provide means for permitting the adjustment of the drink formulation and/or to permit adjustment of the price charged for any given drink dependent upon the time period involved.

It is a further object of the invention to provide a drink dispensing system wherein perishables can be utilized as a component of the system, with additional means being provided to purge the system of the perishables when the same are not being used.

It is a further object of the invention to provide a system wherein the operator will be constantly apprised when the liquid level reaches a certain point so that replenishment of the empty bottle indicated can be accomplished.

It is a further object of the invention to provide a new and improved type of coupling that permits gathering of the fluid lines to a central point and transmitting the same to the pouring station.

It is a further object of the invention to provide a drink dispensing apparatus that features a "parallel" type of dispensing apparatus wherein the ingredients of the drink are dispensed simultaneously to ensure maximum speed in drink dispensing.

It is a further object of this invention to provide an improved type of solid state semi-conductor circuitry that permits achievement of the above-mentioned objectives.

These and other objects of the invention will become more apparent upon a reading of the following brief specification, considered and interpreted in view of the accompanying drawings.

OF THE DRAWINGS:

FIG. 5 is a schematic drawing of the improved solid state control interface.

FIG. 6 is a schematic view of the keyboard.

Figure 10:
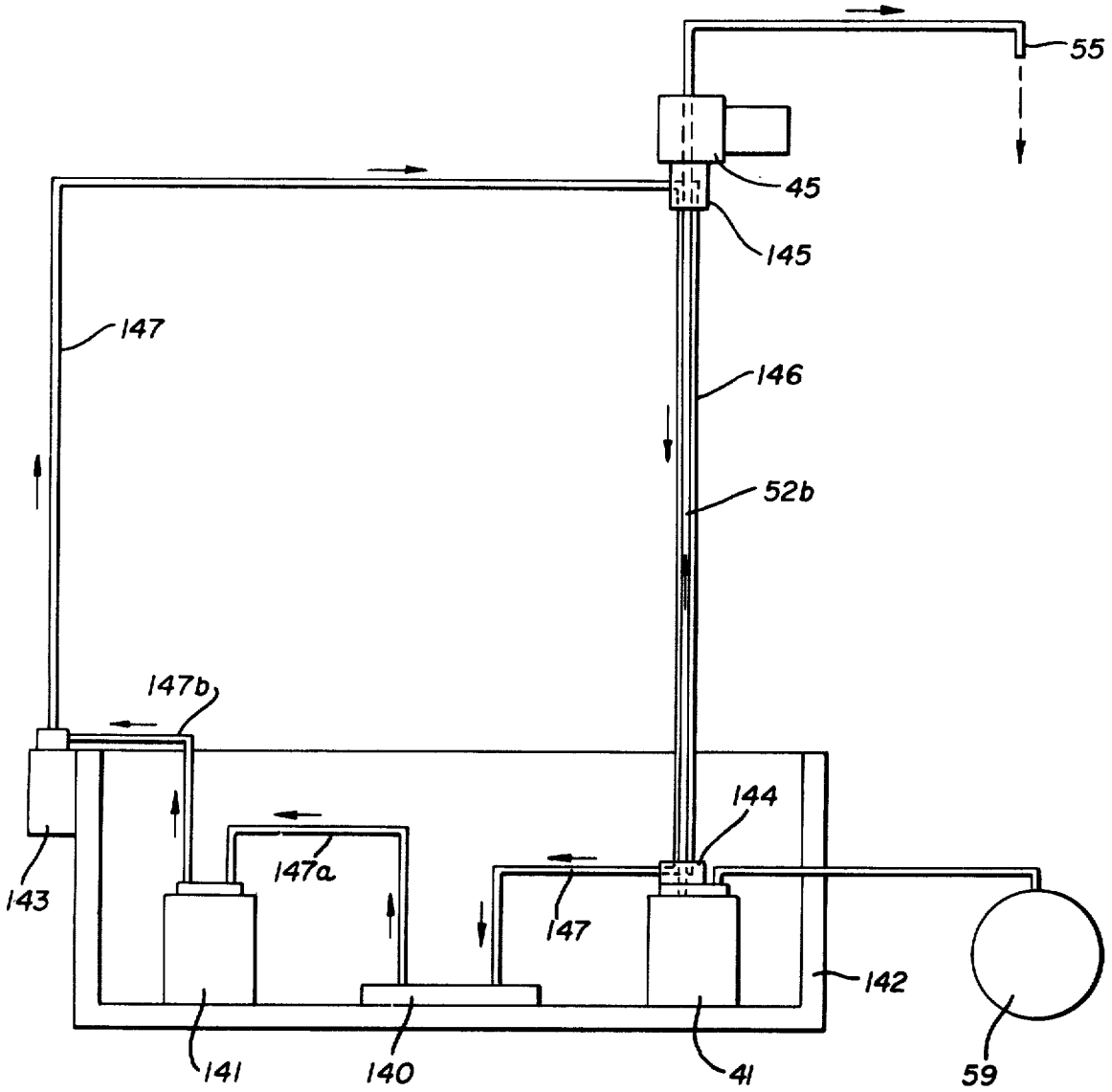
FIG. 10 is a schematic view of the cream cooling system preferably employed with the drink dispensing apparatus.
Figure 10A:
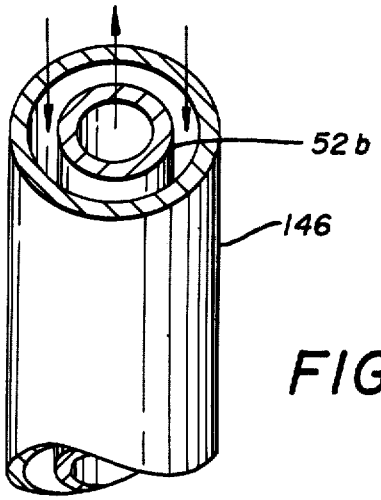

FIG. 10*a* is a perspective view illustrating the construction of the main component line of the cream dispensing unit.

Figure 11:
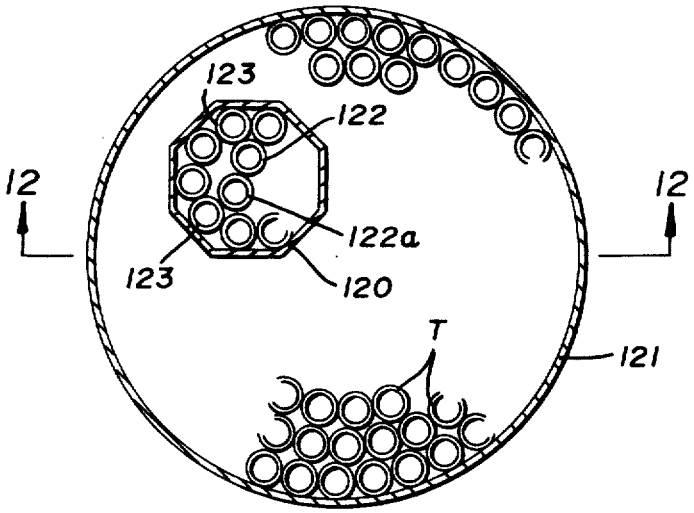

FIG. 11 is a bottom view of the pour head showing the individual dispensing tubes gathered together in drink dispensing position.

Figure 12:
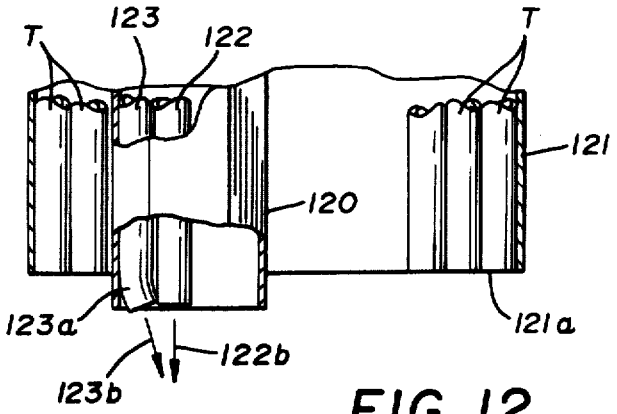

FIG. 12 is a sectional view taken on the lines 12—12 of FIG. 11.

Figure 13:
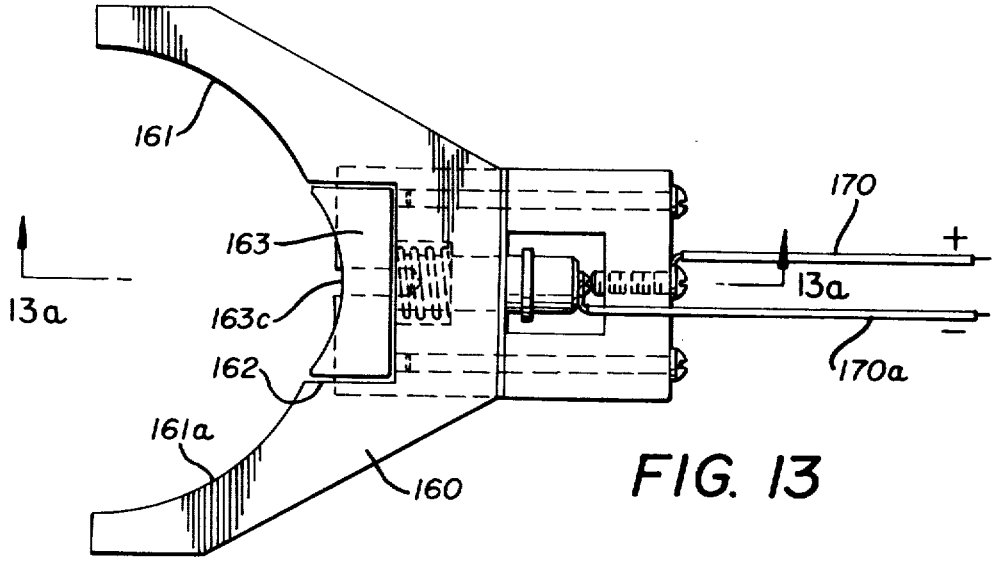

FIG. 13 is a plan view of the head switch assembly employed in the drink dispensing apparatus.

Figure 13A:
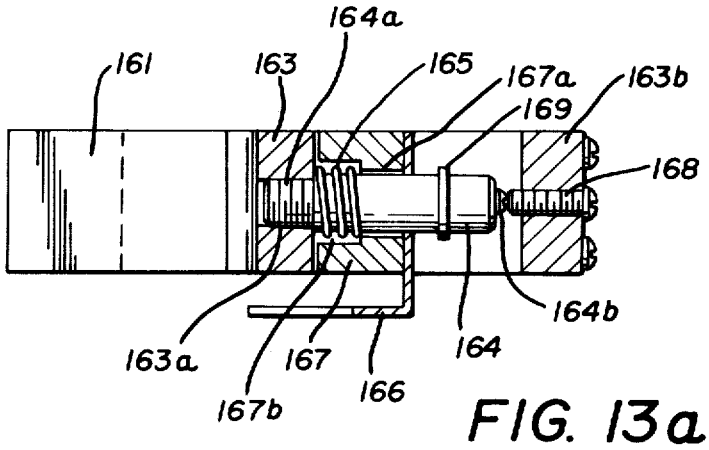

FIG. 13*a* is a sectional view taken along the line 13a, 13a of FIG. 13.

Figure 13B:
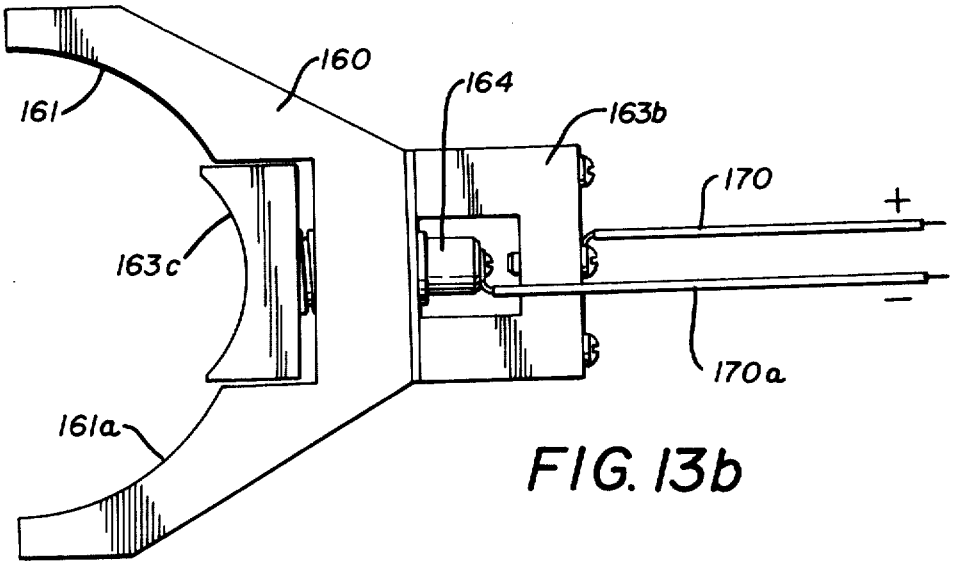

FIG. 13b is a view similar to FIG. 13 but showing the switch in its open position.

Figure 13C:
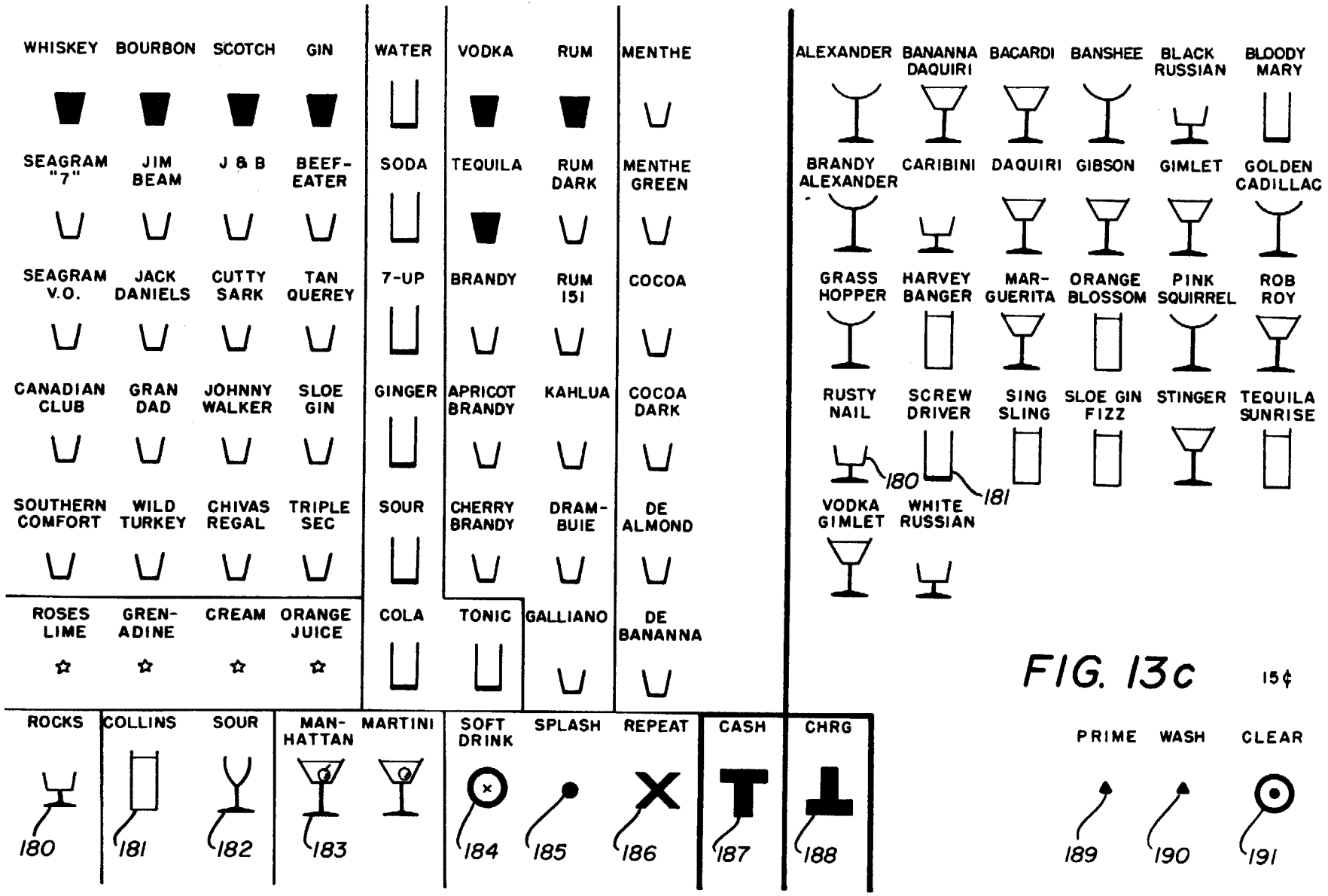

FIG. 13*c* is a view showing the typical keyboard sheet designed for use with the improved apparatus.

FIG. 14 is a circuit schematic of a basic clock generator for the invention.

FIG. 14*a* is a timing diagram of the output signals of the circuit of FIG. 14.

FIG. 15 is a circuit schematic of the memory system and keyboard interrogation circuitry of the invention.

Figure 16:
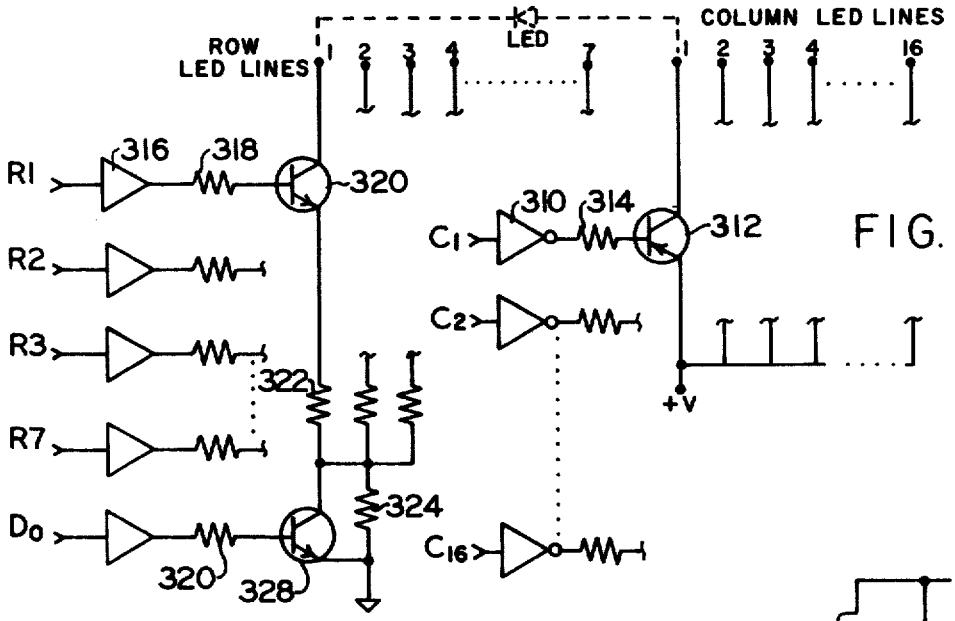

FIG. 16 is an illustrative showing of the circuitry utilized for driving the light emitting diodes of the keyboard.

Figure 17A:
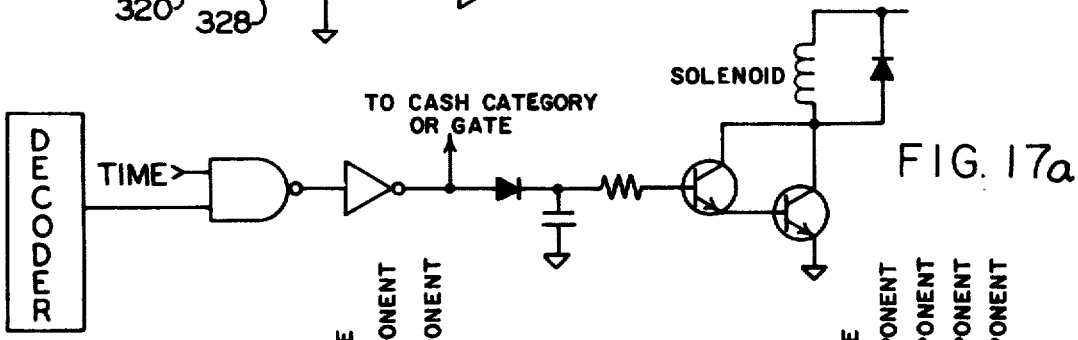
Figure 17:
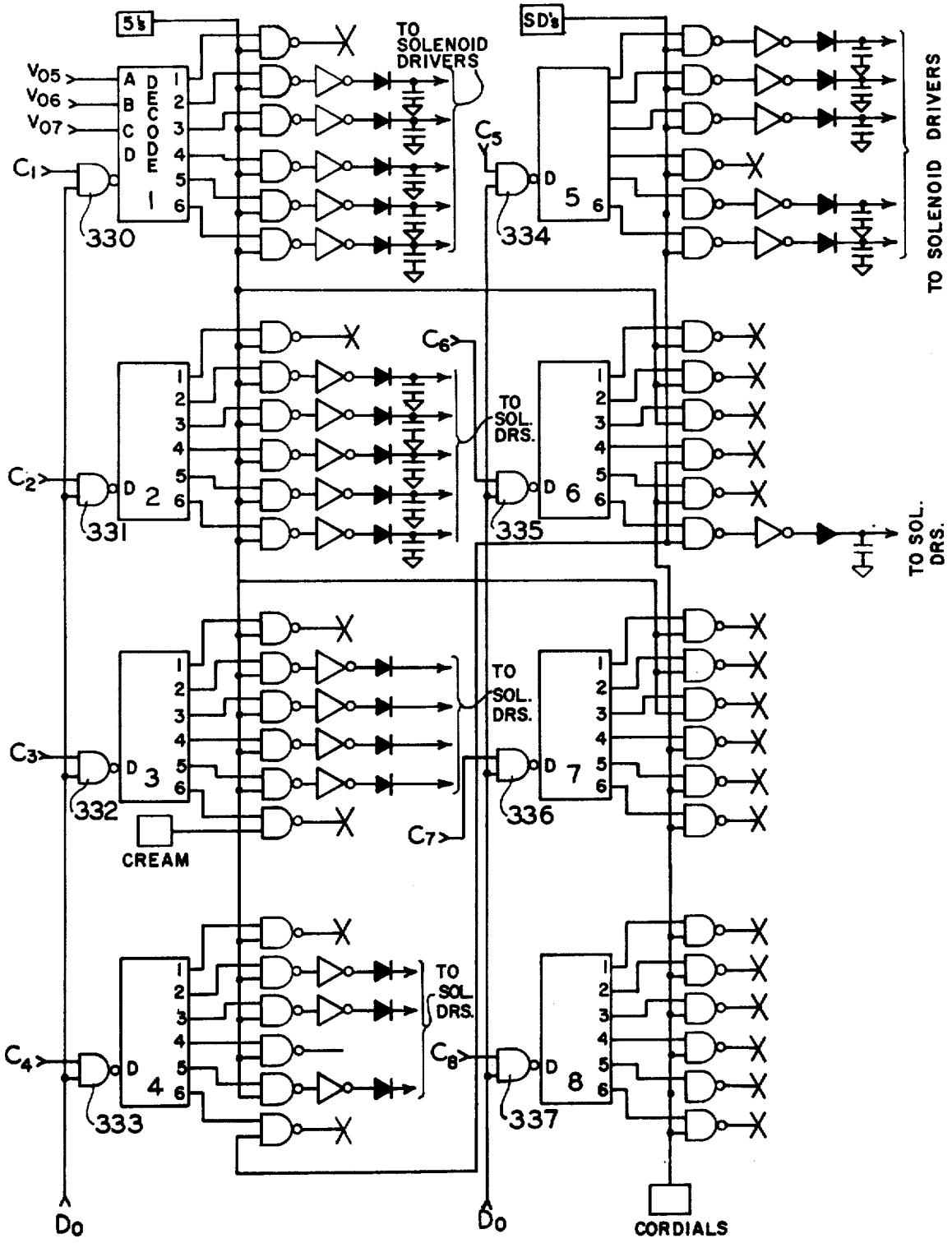

FIG. 17 is a circuit schematic of the decoders associated with the leftside of the keyboard for determining which components have been selected.

FIG. 17*a* is a circuit diagram of a typical solenoid driver utilized in the invention.

Figure 18:
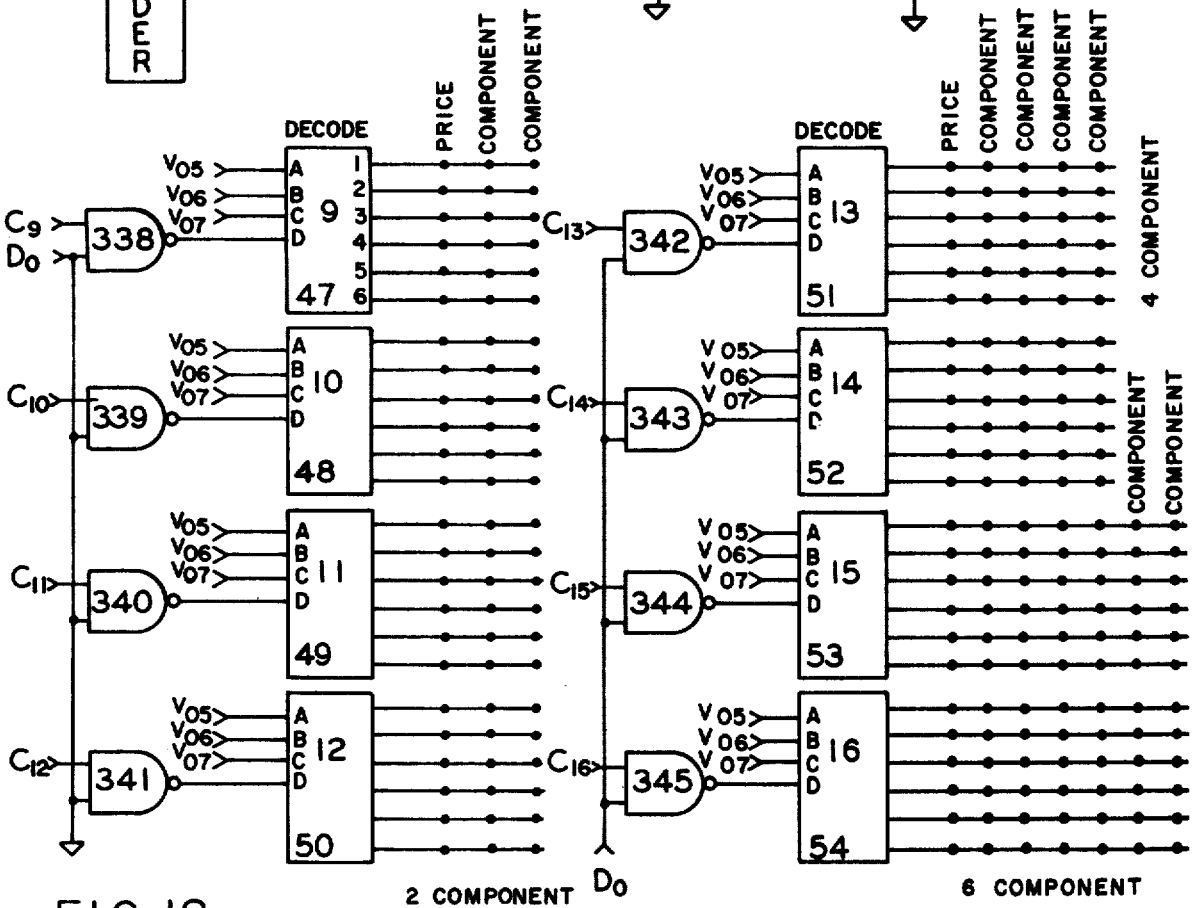

FIG. 18 is a circuit schematic of the decoders associated with the righthand side of the keyboard.

Figure 19A:
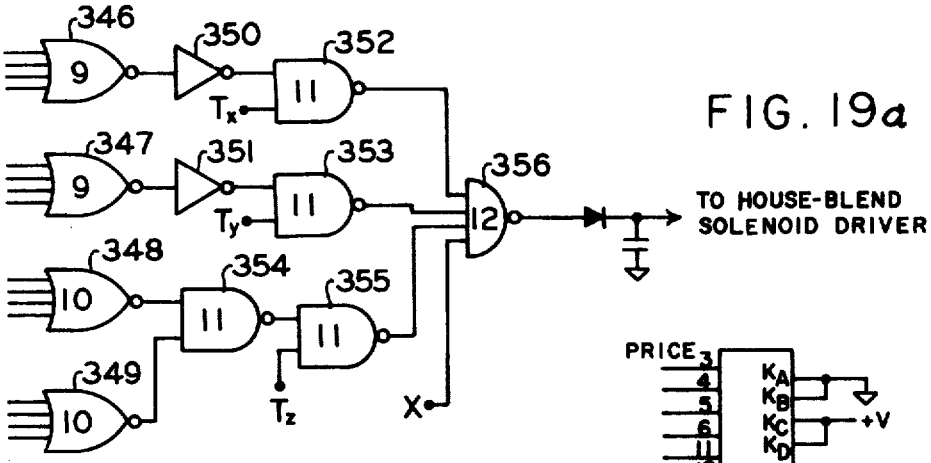

FIG. 19*a* is a circuit schematic of the timing and component selection patchboard of the invention.

Figure 19B:
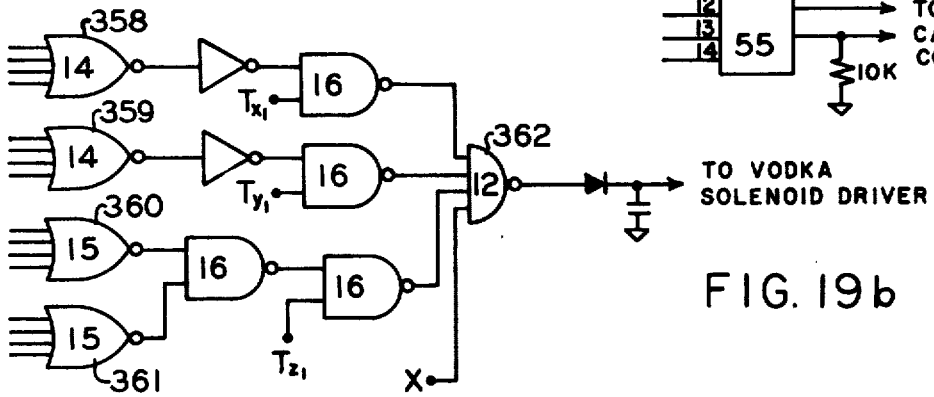

FIG. 19*b* is another showing of a typical patchboard circuit similar to that shown in FIG. 19*a*.

Figure 20:
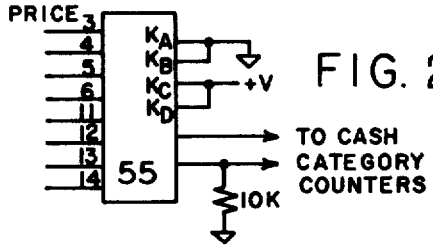

FIG. 20 is a showing of a typical expandable OR gate utilized for patching to the cash category counters.

Figure 21:
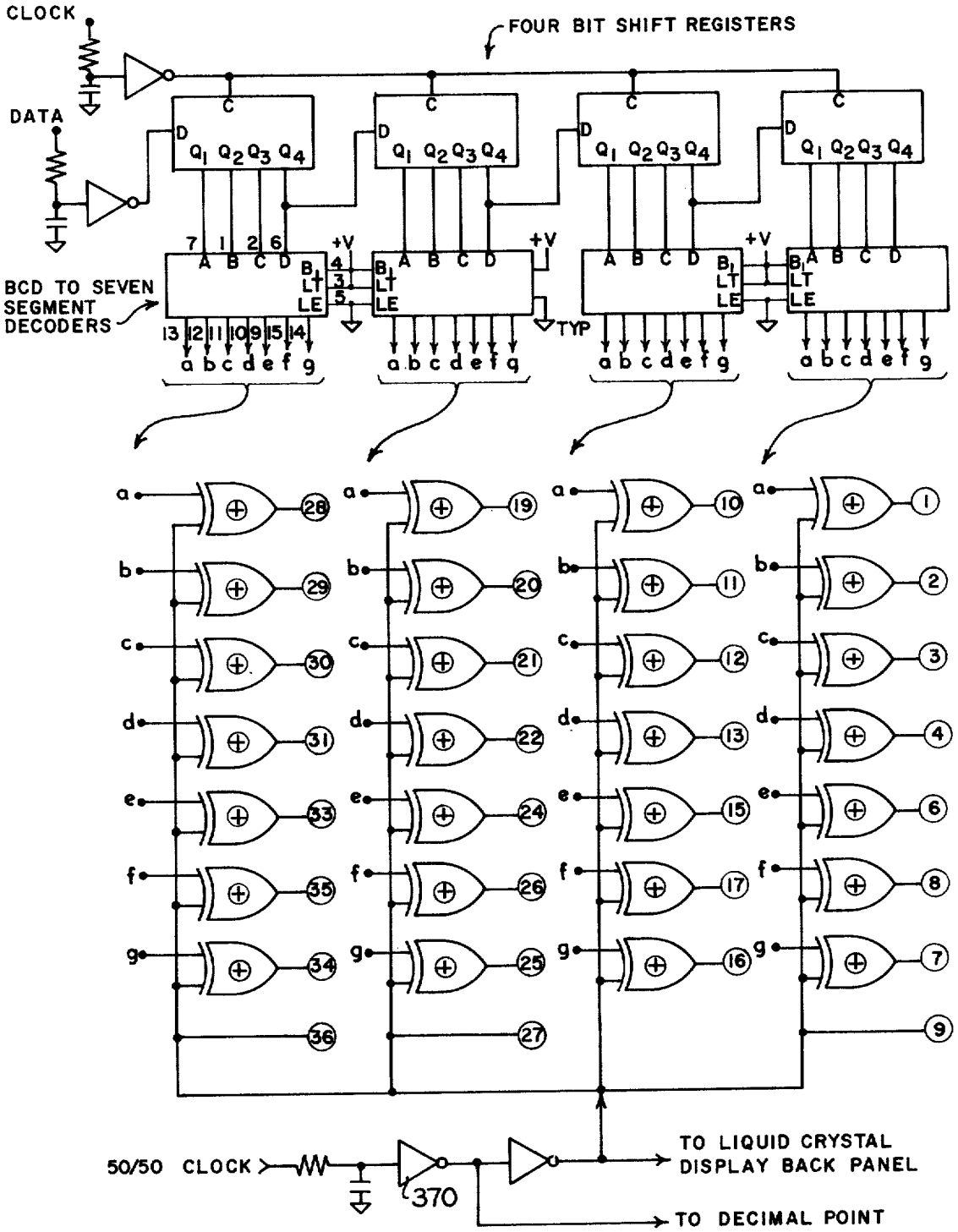

FIG. 21 is a schematic showing of the circuitry for controlling the liquid crystal price display unit.

Figure 22:
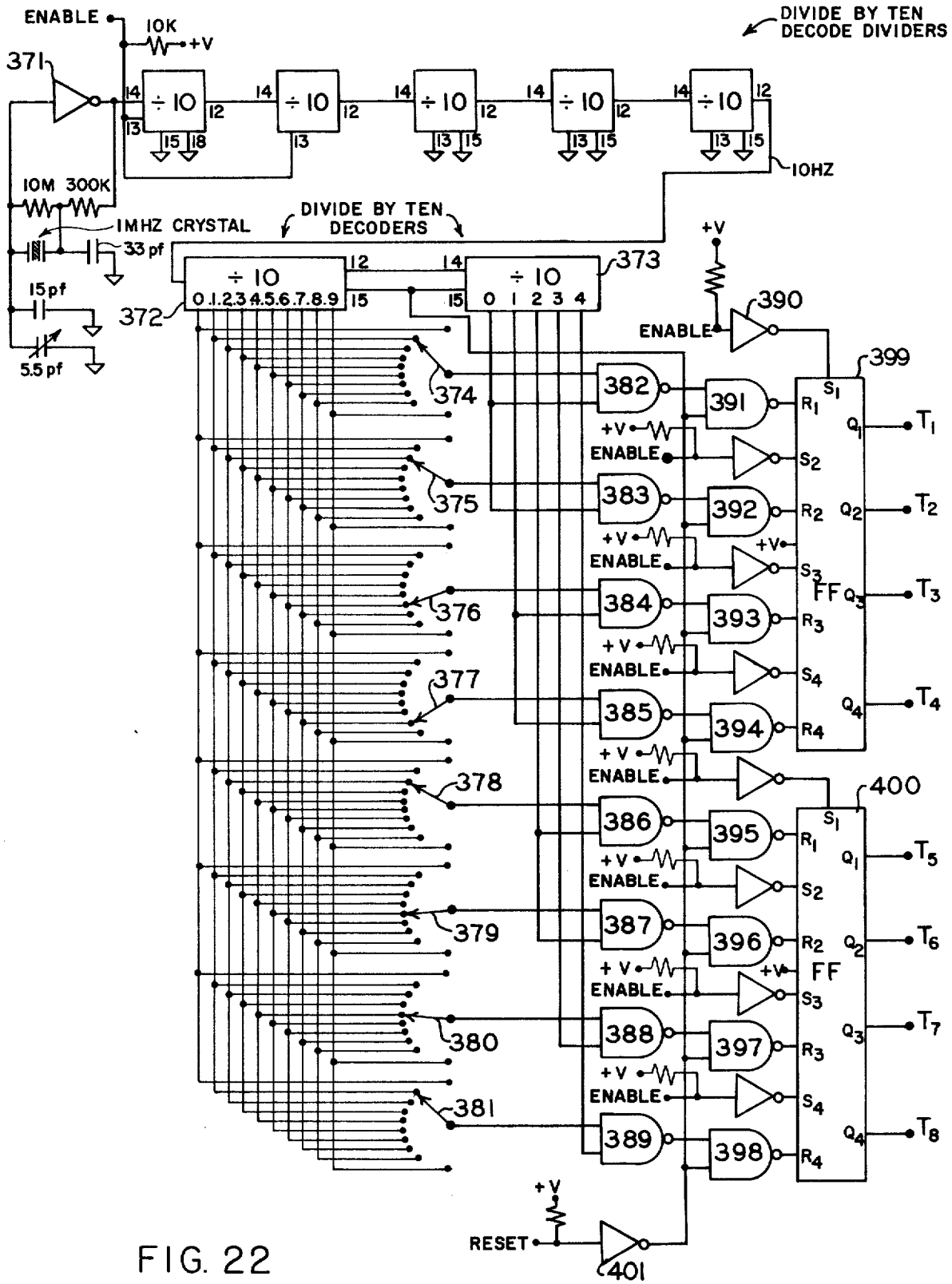

FIG. 22 is a circuit diagram of the timing circuit of the invention.

Figure 23:
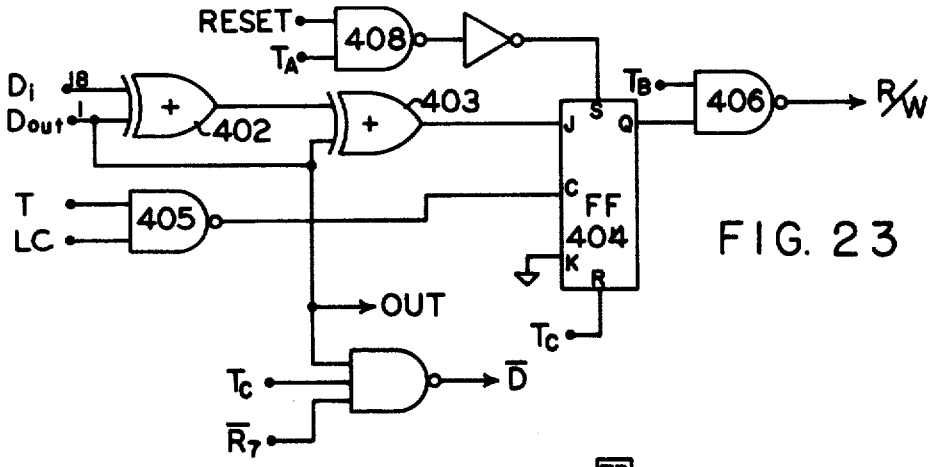

FIG. 23 is a circuit diagram of a control circuit of the invention.

Figure 24:
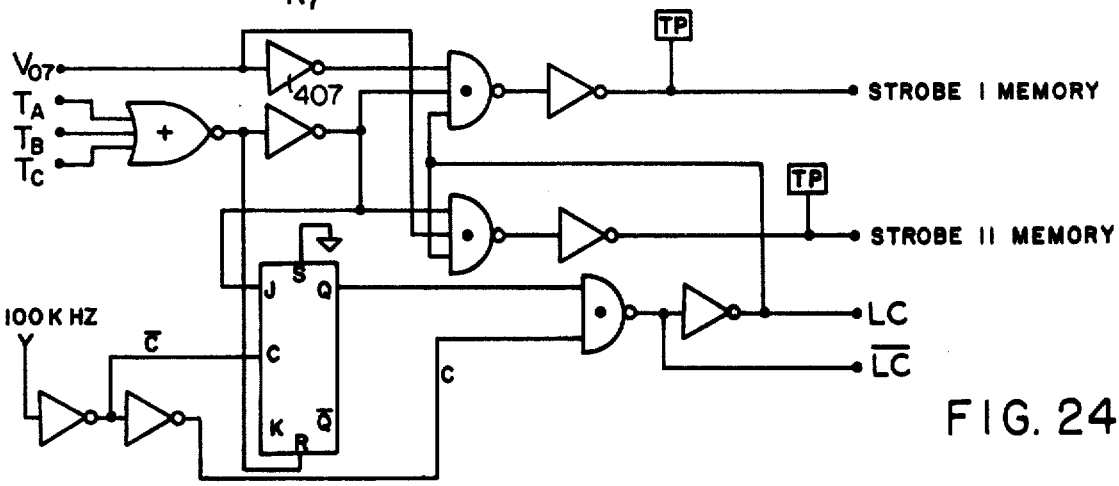

FIG. 24 is a circuit diagram of the strobe signal generator of the invention.

FIG. 25 is a circuit diagram of further control circuitry of the invention actuated by the pour switch.

Figure 26:
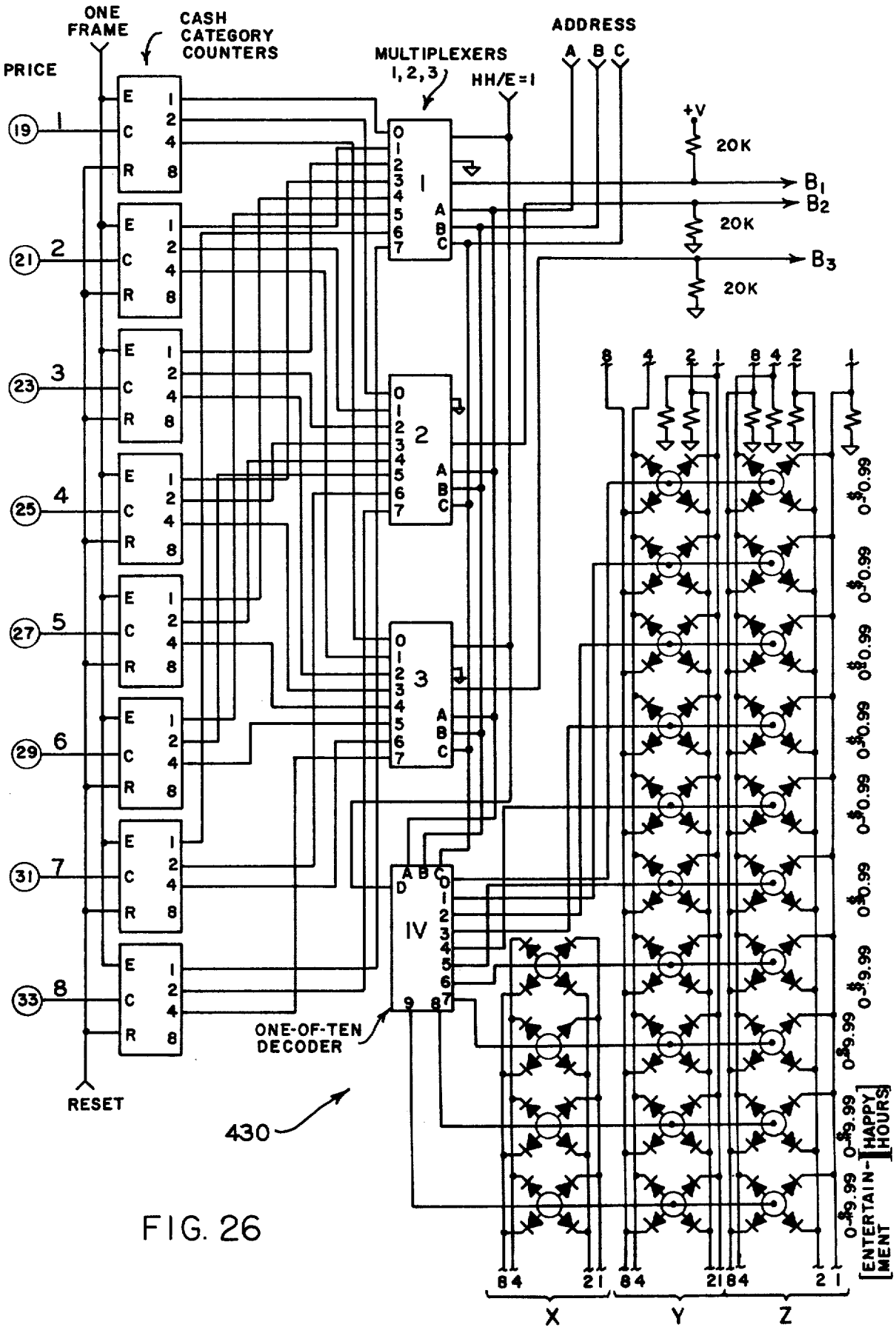

FIG. 26 is a schematic diagram of the cash category counters and the associated pricing circuitry.

Figure 27:
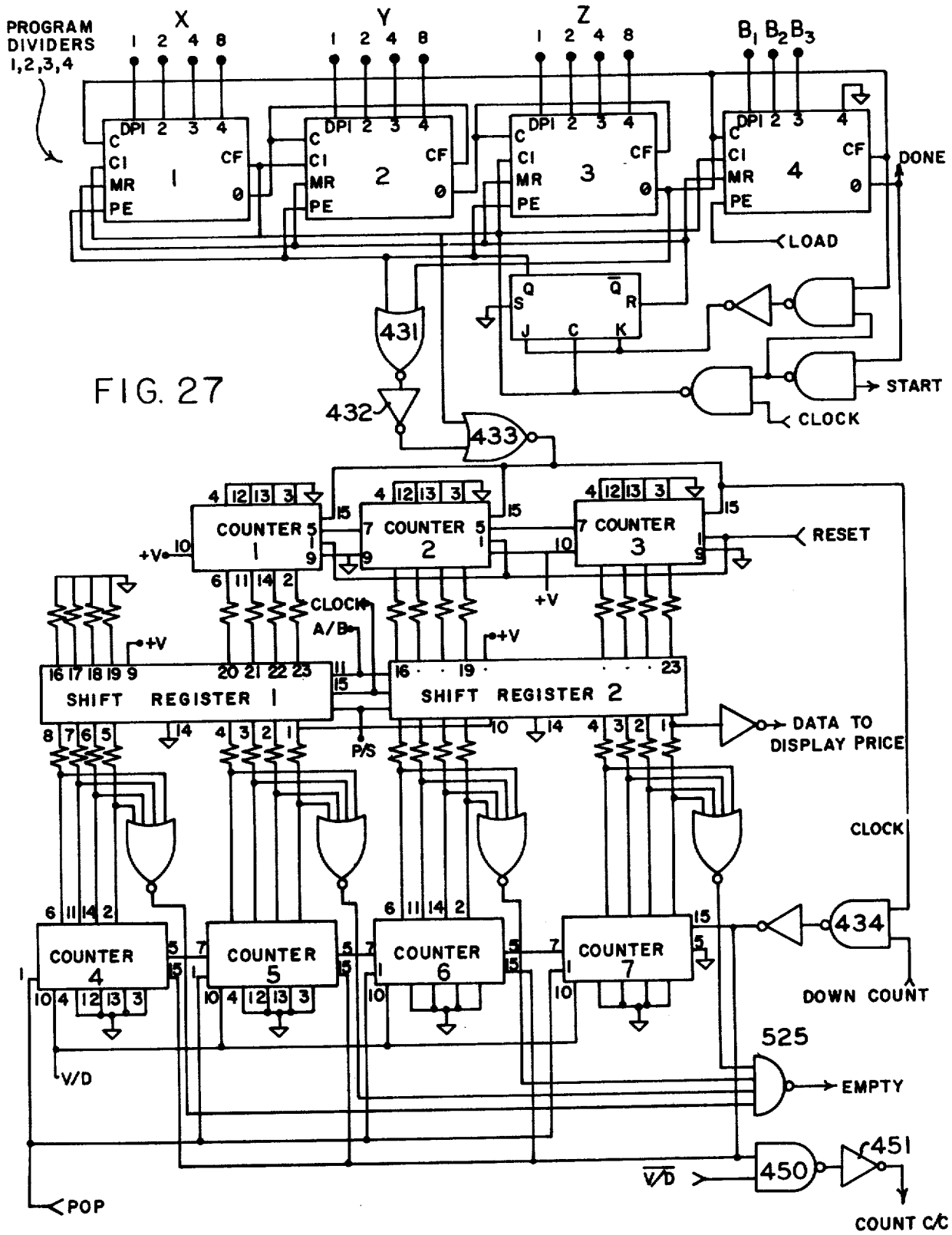

FIG. 27 is a schematic diagram of the single drink and customer totalizing counters and the control logic therefore.

FIG. 28 is a showing of the basic clock circuit required in the cash and control circuitry.

Figures 29, 31:
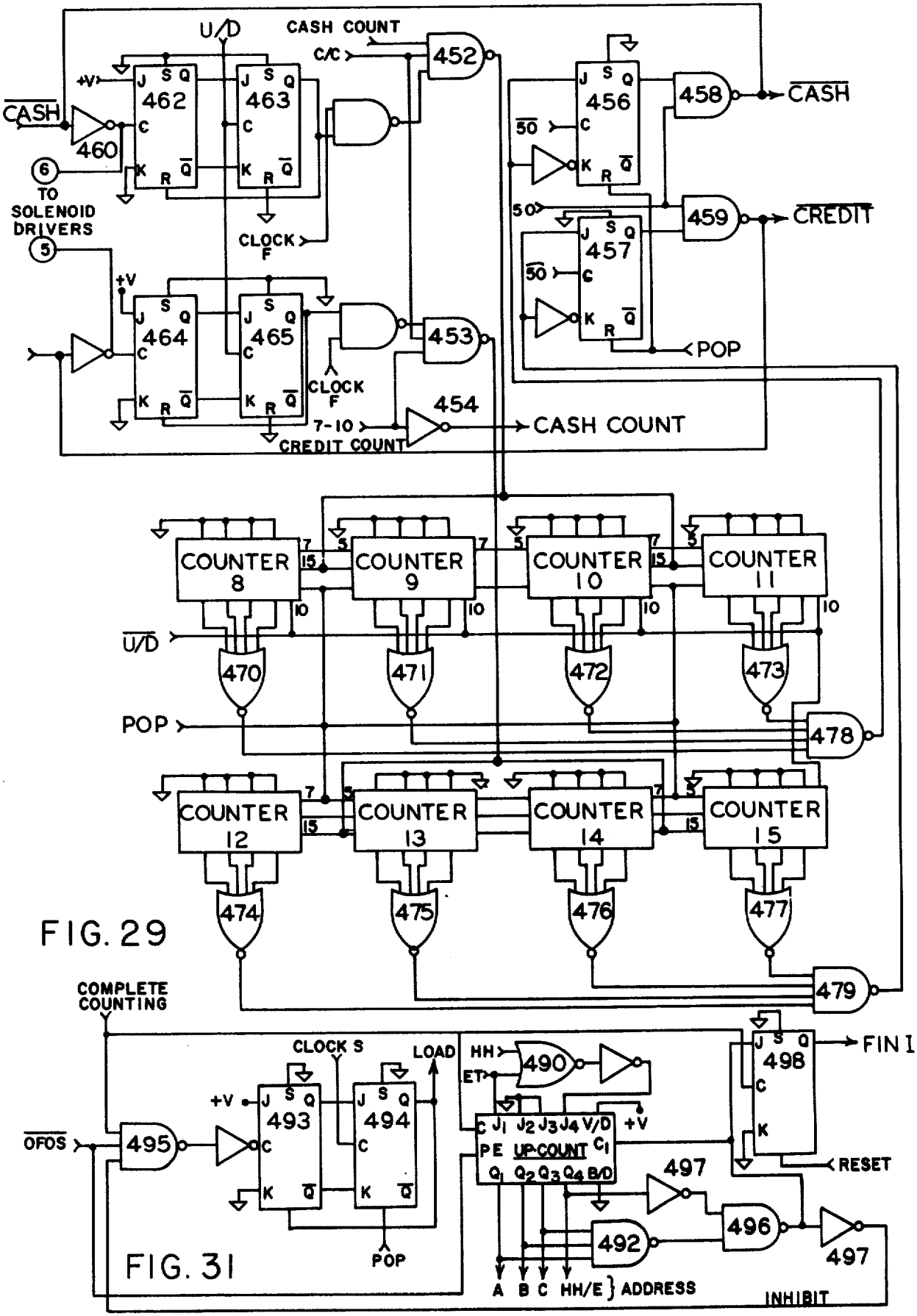

FIG. 29 is a schematic diagram of the circuitry required for creation of the pulses for actuating the remote electro-mechanical counters.

FIG. 30 is a schematic showing of the clock generation for control of the electro-mechanical counters.

FIG. 31 is a schematic showing of the circuitry required for addressing the multiplexers of FIG. 26.

Figure 32:
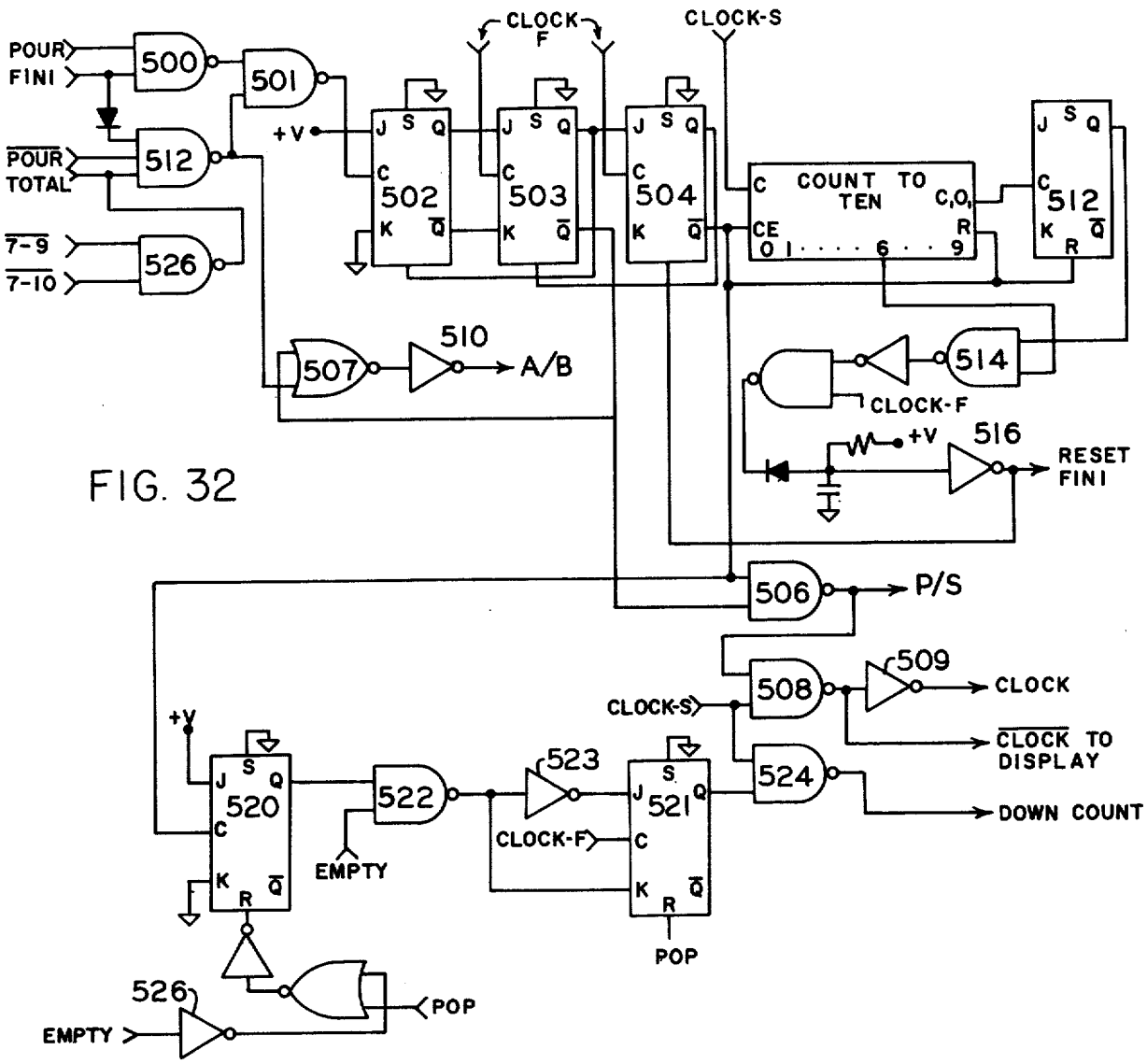

FIG. 32 is a control circuit for generating many of the control signals required by the cash and control circuitry.

FIG. 33 is a schematic illustration of the circuitry generating the power on and protect signal.

Figure 34:
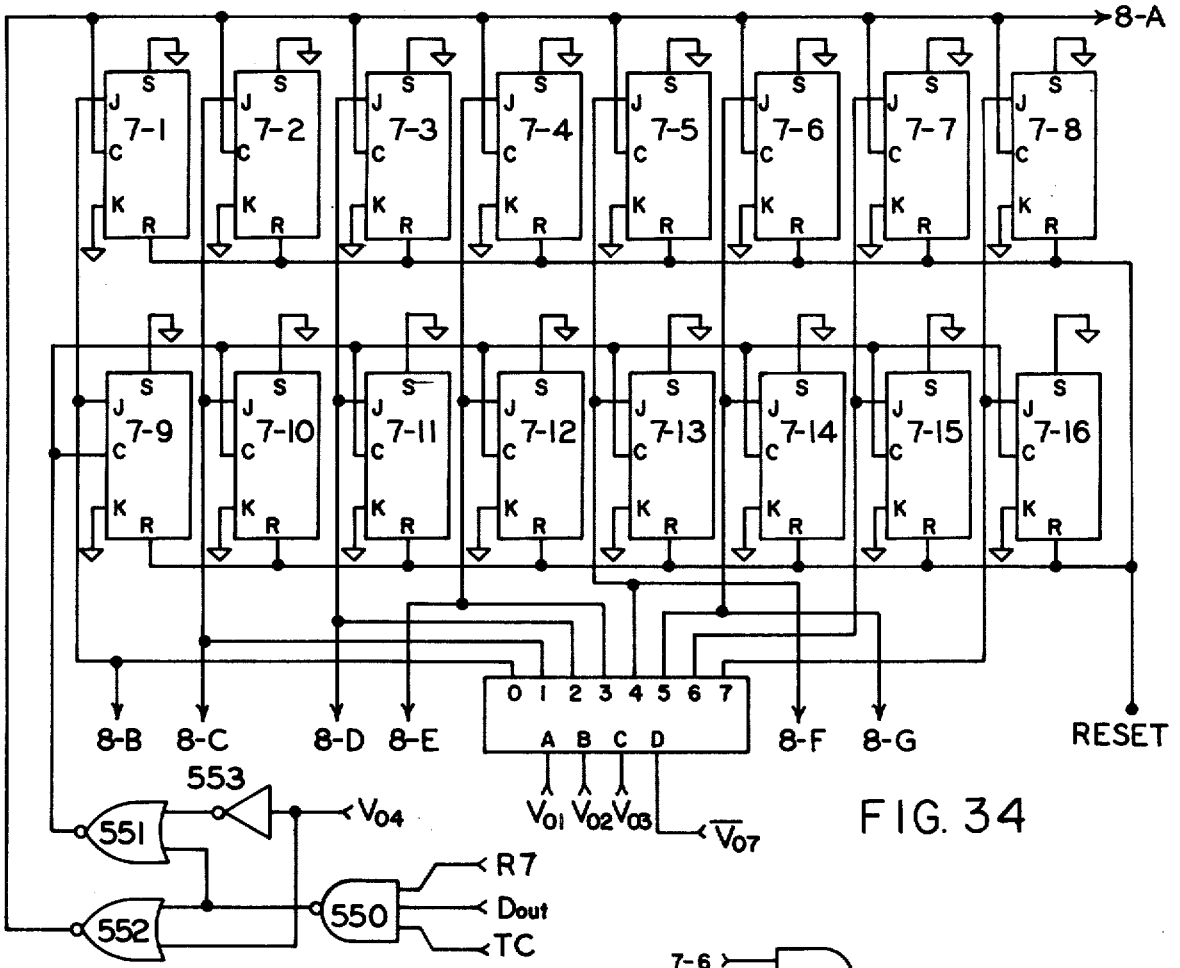

FIG. 34 is a circuit diagram of a flip flop array associated with the function row of the keyboard.

Figure 35:
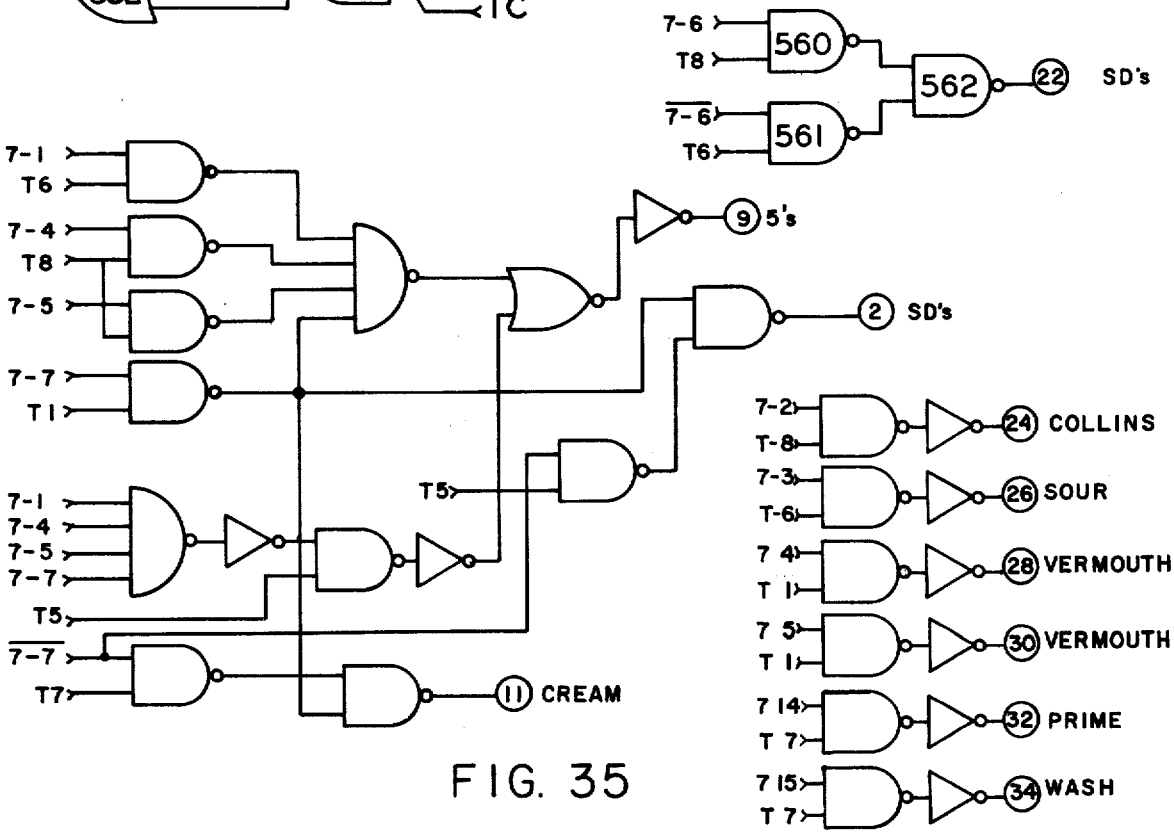

FIG. 35 is a circuit diagram of a gating network controlling the timing through the solenoid drivers.

Figure 36:
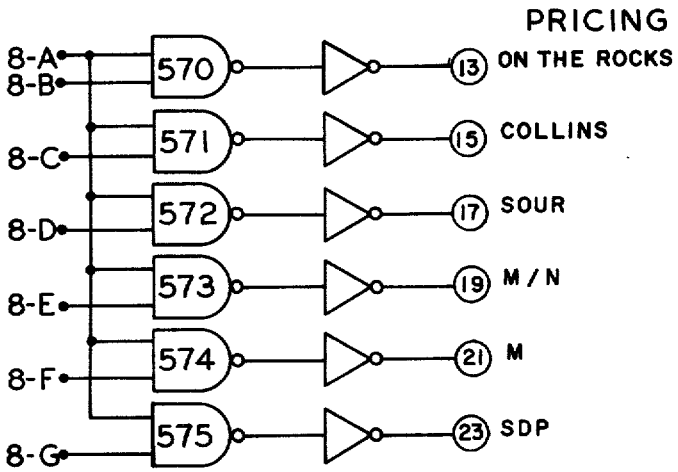

FIG. 36 shows a logic network associated with the function switches of the keyboard for regulating component dispensing.

Figure 37:
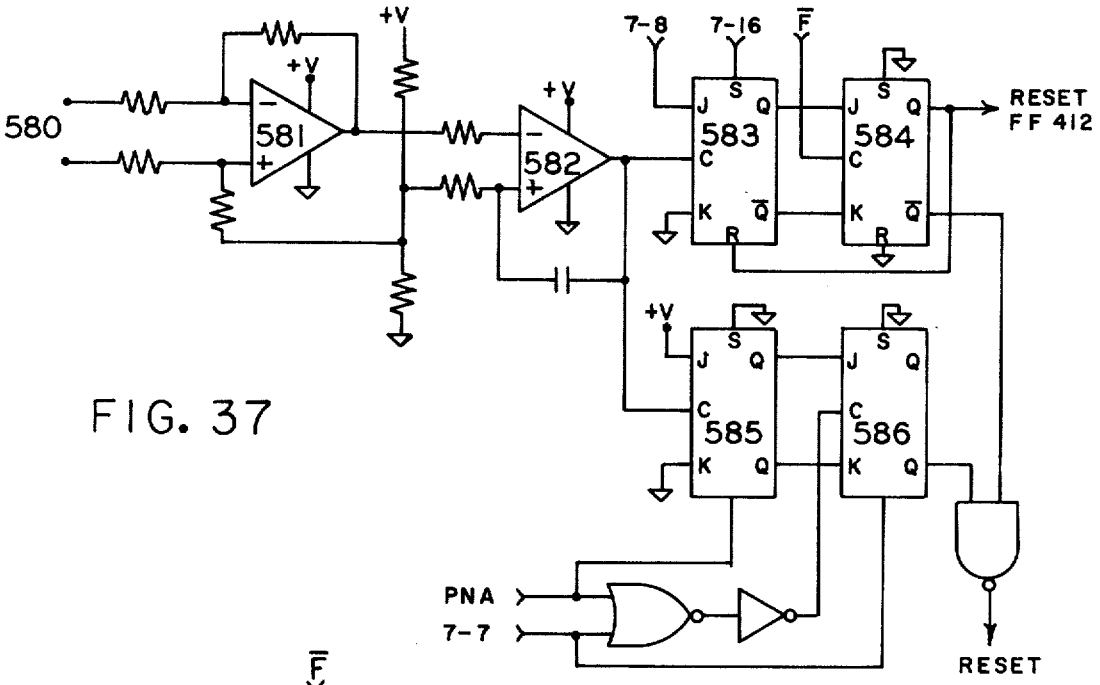

FIG. 37 is a circuit diagram of the reset pulse generating circuit.

Figure 38:
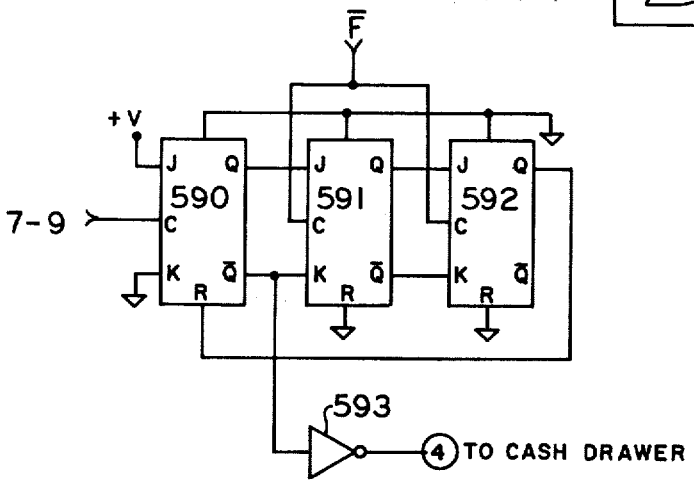

FIG. 38 shows a circuit operative to actuate the cash drawer solenoid.

Figure 39:
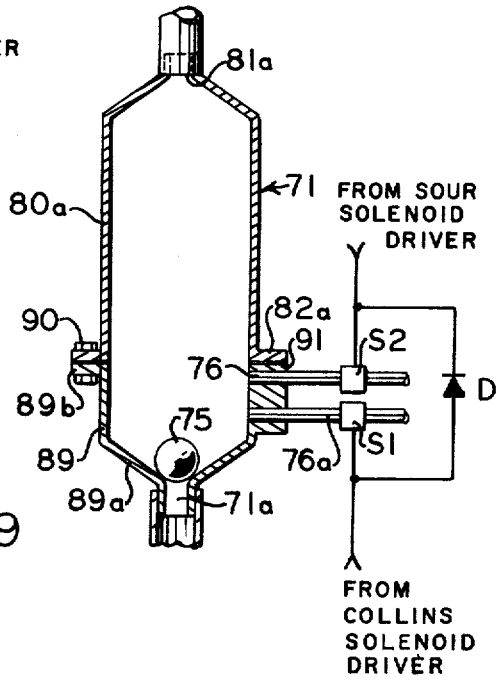

FIG. 39 is a diagram of a dispensing reservoir having two dispensing tubes associated therewith to achieve the double pour technique.

Figure 40:
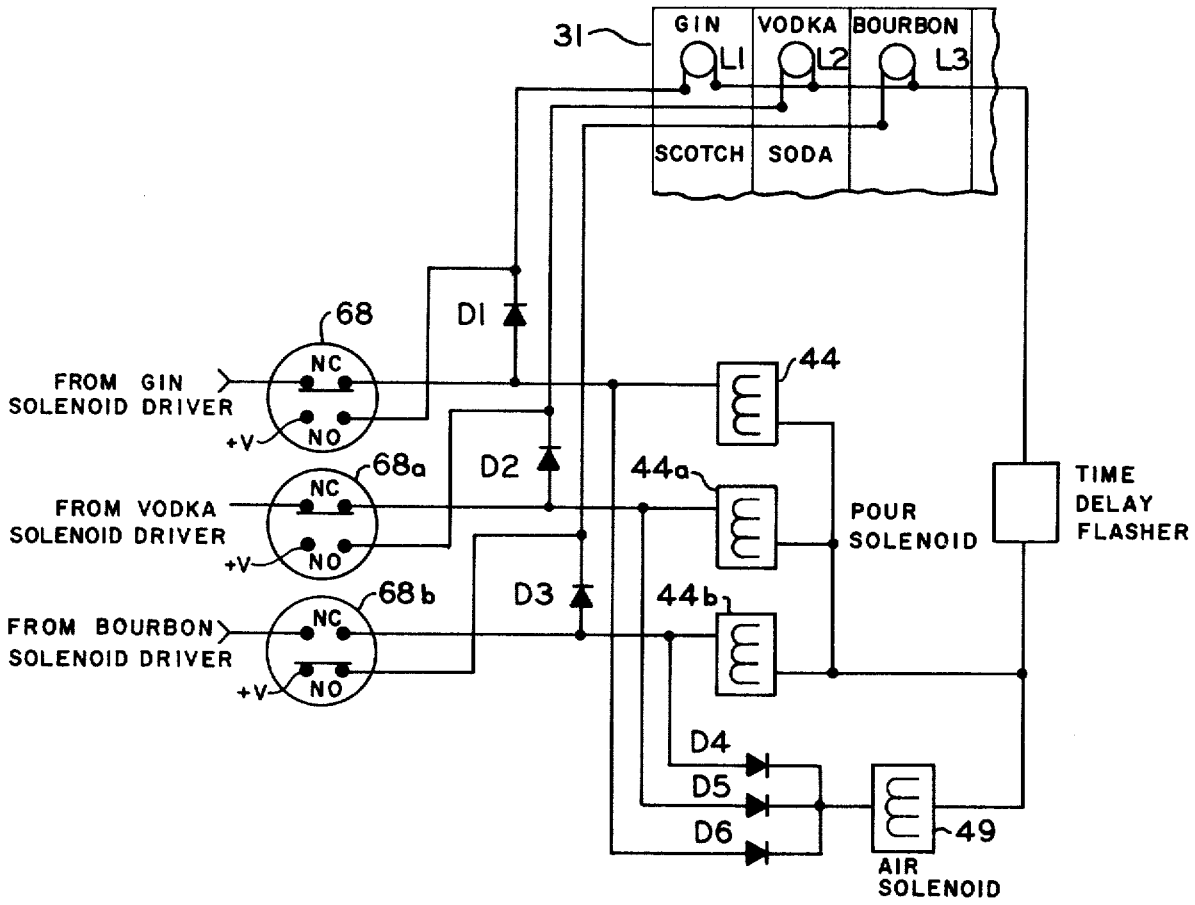

FIG. 40 is a schematic diagram showing the display panel electronics, the electronic interconnection between the air solenoids and pour solenoids, and the fluid level detection switches and their interconnection with the display panel.

DETAILED DESCRIPTION OF THE INVENTION

A. Overall System

Figure 1:
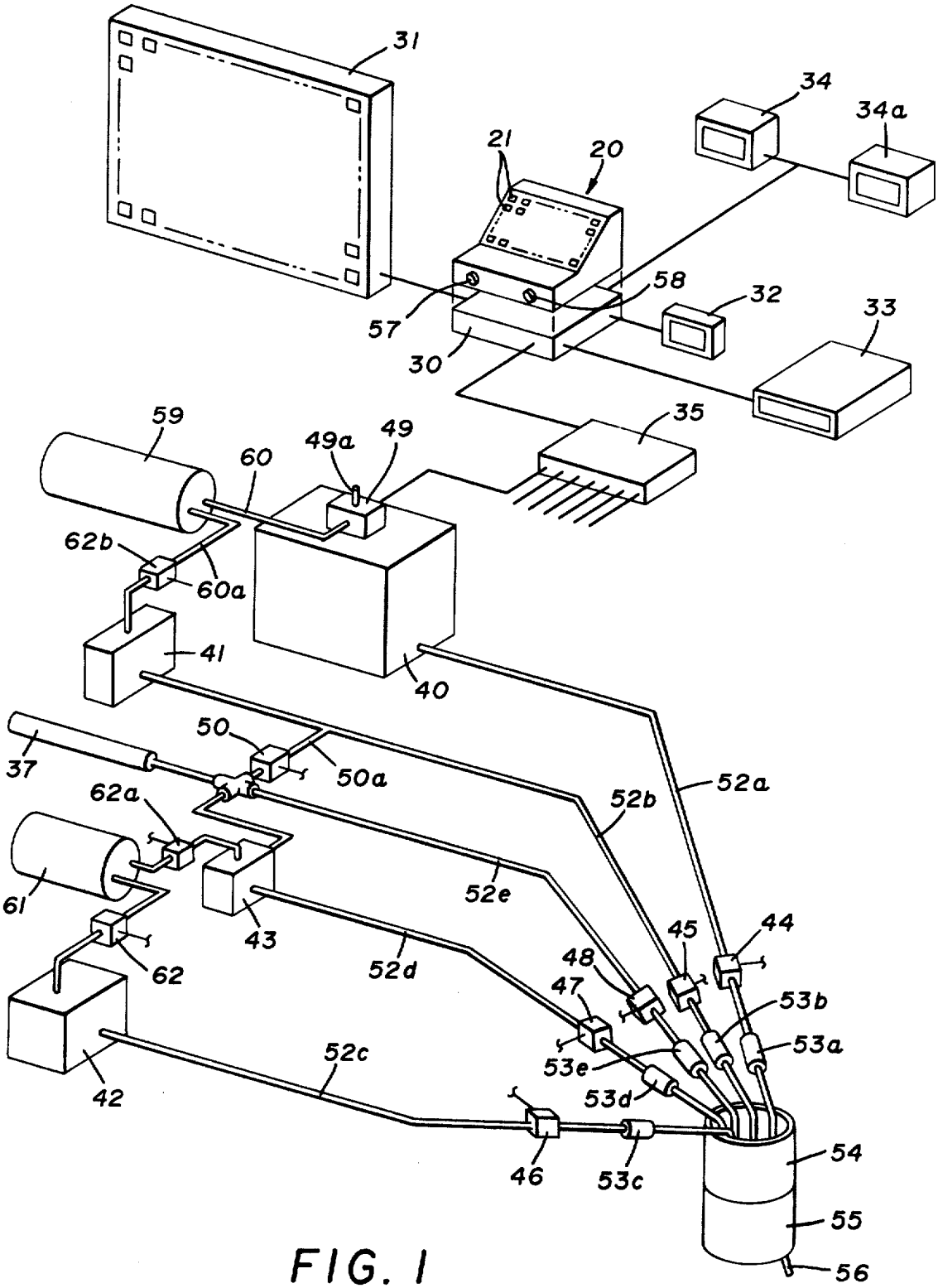
FIG. 1 is a schematic view, shown in perspective, and schematically illustrating the principal components of the drink dispensing apparatus.

Referring to the drawings and in particular to FIG. 1, an operator-controlled keyboard 20 is connected, through solid state technology that is schematically illustrated in FIG. 1, to a console interface 30 so as to activate one or more of the following components that are also shown and connected schematically to the interface 30 dependent upon which of the keyboard buttons 21,21 are selected:

A Display panel 31
B Price display unit 32
C Cash drawer 33
D Remote totalizers 34, 34*a*
E Solenoid drivers 35
F Beer reservoir and dispenser 36
G Water source 37
H Alcohol pump dispensing means 40
I Perishables reservoir 41
J Syrup reservoir 42
K Carbonator 43
L Solenoids 44 to 48
M Three way solenoid 49

The arrangement above summarized is such that when one or more of the solenoids 44 through 48 is electronically "opened," liquid from either pump dispensing means 40, reservoir 41, reservoir 42, or carbonator 43, or source pressure 37 will be delivered through lines 52*a* through 52*e* to hydraulic accumulators 53*a*, 53*b*, 53*c*, 53*d*, and 53*e* and thence through a connector unit 54 for delivery to the pouring head 55, where the selected drink will be dispensed into a glass positioned beneath the pouring head 55 upon activation of switch 56.

Key controls 57, 58 are provided on the keyboard 20 for the respective purpose of "locking" the system against operation as in the case of key control 57, and to effectuate a change in the pricing structure by use of the key control 58.

The compressed air reservoir 59 delivers air under pressure to the alcohol reservoir 40 and the perishables reservoir 41 through lines 60 and 60*a* respectively, with the three-way solenoid 49 being interposed in line 60*a* for the dual purpose of supplying air under pressure to the alcohol dispensing unit 40 for short periods of time, whereupon it is exhausted through the exhaust portion 49*a* of the three-way solenoid valve in a manner that will be described in greater detail.

A $CO_2$ container 61 delivers pressurized $CO_2$ to the syrup reservoir 42 and the soda reservoir 43.

Regulators 62, 62*a*, and 62*b* serve to control the gas or air pressure delivered to the syrup reservoir 42 and the carbonator 43 by $CO_2$ source 61 and to the alcohol reservoir 40 and the perishables reservoir 41 by compressed air source 59.

Solenoid 50 is interposed in line 50*a* for the purpose of permitting the line 52*b* to be purged when the solenoid 50 is open to pressurized flow from the water means 37.

By this arrangement, when the solenoids 50 and 45 are "open" and the solenoid 48 is "closed," the line 52*b* will be purged.

On the other hand, when the solenoid 50 is "closed" and the solenoid 48 is "opened," the water will flow directly to the pouring head through solenoid 48. Finally, when solenoid 47 is "open," water will be supplied through the carbonator 43 for delivery to the pouring head in the form of carbonated water.

While the principal elements of the combination have been described, there are certain other things that will happen in addition to the dispensing of the drink in the manner above described.

First, the interface 30 will electronically activate the solenoid drivers 35 to cause the appropriate ingredients to be simultaneously dispensed to the pouring head 55 in the manner that will be described in greater detail at a later point.

Secondly, during the dispensing of this drink, the ingredient and/or ingredients being dispensed will be shown on the display board 31, and when the drink has been poured, the drink will be priced, with the price being shown on the price dislay unit 32. At the same time, this price will be totaled into the amount shown on the remote totalizers 34 (for cash) and 34*a* (for credit) so that the owner and proprietor can keep a running track of the days of business if he so desires.

Finally, if it is a cash sale, the operator can push the cash drawer button which will cause the cash drawer to open for the purpose of receiving the monies so paid. Preferably this unit will have an arrangement wherein the drawer 33 will not open until after a drink has been dispensed so as to prevent tampering or pilferage.

B. General Arrangement of the Alcohol Dispensing Unit 40, the Reservoir 41 and 42, and the Carbonator 43

While the overall arrangement of the alcohol dispensing unit 40, the reservoirs 41 and 42, and the carbonator 43 has been schematically shown in block diagram form in FIG. 1 as described above, FIG. 2 shows further detail as to how the several bottles or containers that comprise each of the above units will be arranged for use in the overall system.

Figure 2:
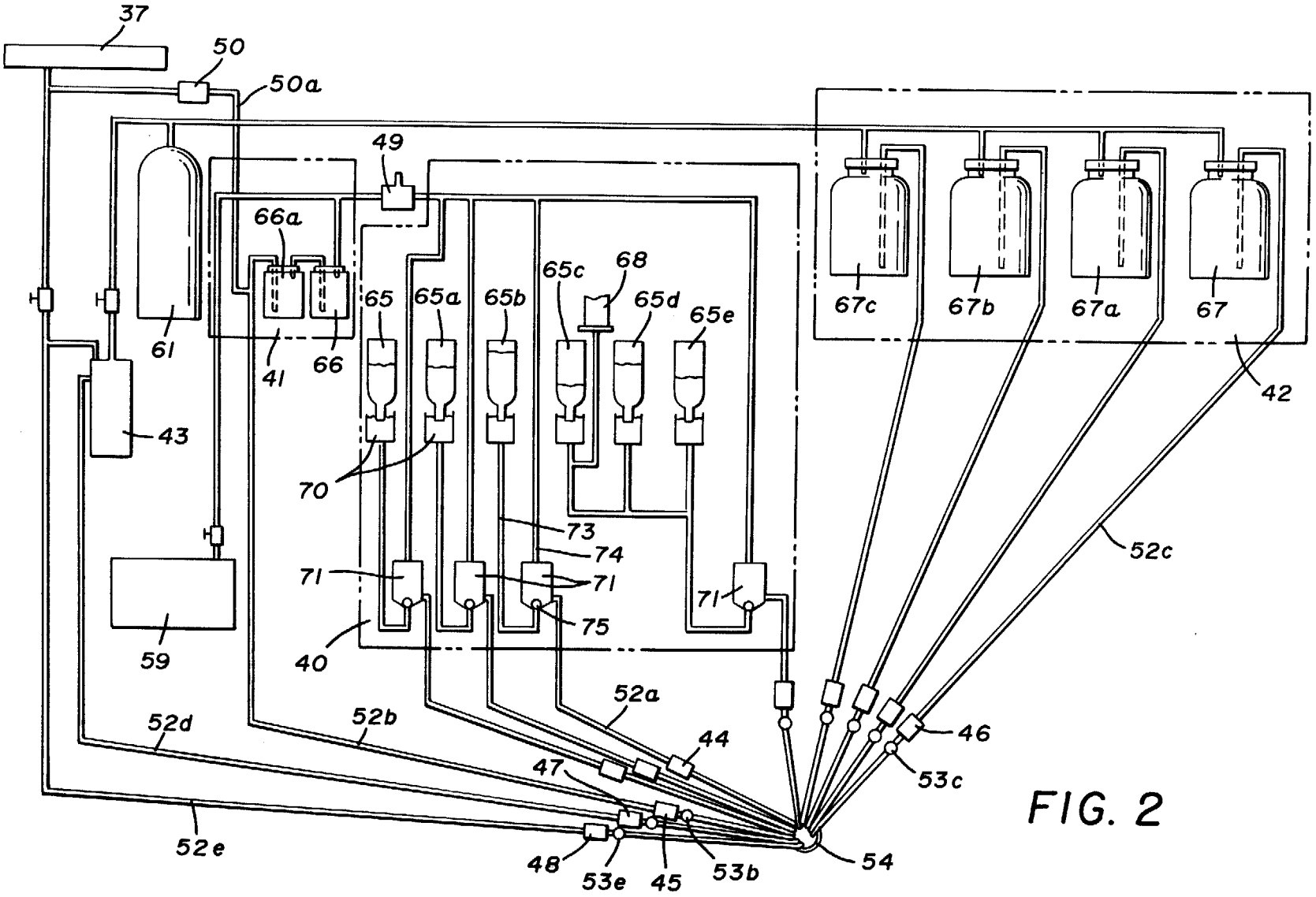
FIG. 2 is a similar schematic view showing in detail a plurality of the principal components that make up each portion of the system.

Thus and referring to FIG. 2, it will be noted that the alcohol dispensing unit 40 contains six bottles 65, 65*a*, 65*b*, 65*c*, 65*d*, and 65*e*, while the cream reservoir 41 is shown including two containers 66 and 66*a*.

Four syrup containers 67, 67*a*, 67*b*, and 67*c* are similarly provided in the syrup reservoir 42 of the schematic representation shown in FIG. 2.

Concerning interconnection with the pressure sources, the carbonator 43 is shown connected to the $CO_2$ source 61 as well as to the water source 37 so as to discharge carbonated water to the pouring head 55 through line 52*d* upon opening of solenoid 47. Purge line 50*a* and solenoid 50 also are shown connected between the water source 37 and the perishables containers 66 and 66*a* of reservoir 41.

Also in this regard the compressed air reservoir 59 is shown in FIG. 2 as being operatively associated with (1) the containers 66 and 66*a* of reservoir 41, and (2) the containers 65, 65*a*, 65*b*, 65*c*, 65*d*, and 65*e*, with three-way valve 49 being used to control the operation of the pump means that are associated with the containers in a manner that will be described.

A low level switch 68 is also illustrated in FIG. 2 as being associated with the bottles 65*c*, 65*d*, and 65*e*, with it being understood that all other bottles will have similar switches in the preferred operation of the apparatus, with the low level switches serving to activate a signal to apprise the owner of the fact that the bottle level is low so as to thus permit him to change the same.

Before turning to the detailed construction of the pump mechanics that are employed with each bottle 65, 65*a*, 65*b*, 65*c*, 65*d*, and 65*e*, it should be noted that the bottles 65, 65*a*, and 65*b* contain different ingredients, while the bottles 65*c*, 65*d*, and 65*e* contain similar ingredients so as to permit repeat dispensing of a high volume article or popular brand that would be used more frequently that the other items.

Containers 67 and 67*a*, 67*b*, and 67*c* are standard pressurized containers available commercially, as are the containers 66 and 66*a*, with it being noted that the containers 66 and 66*a* more preferably are stored in a remote refrigerated location.

Also the carbonator 43, compressed air valve 59, and the $CO_2$ valve 61 are all standard components, with no novelty per se being claimed in that regard but rather as regards to their use in the unique combination in this invention.

C. Liquid Dispensing Means

Figures 3, 4:
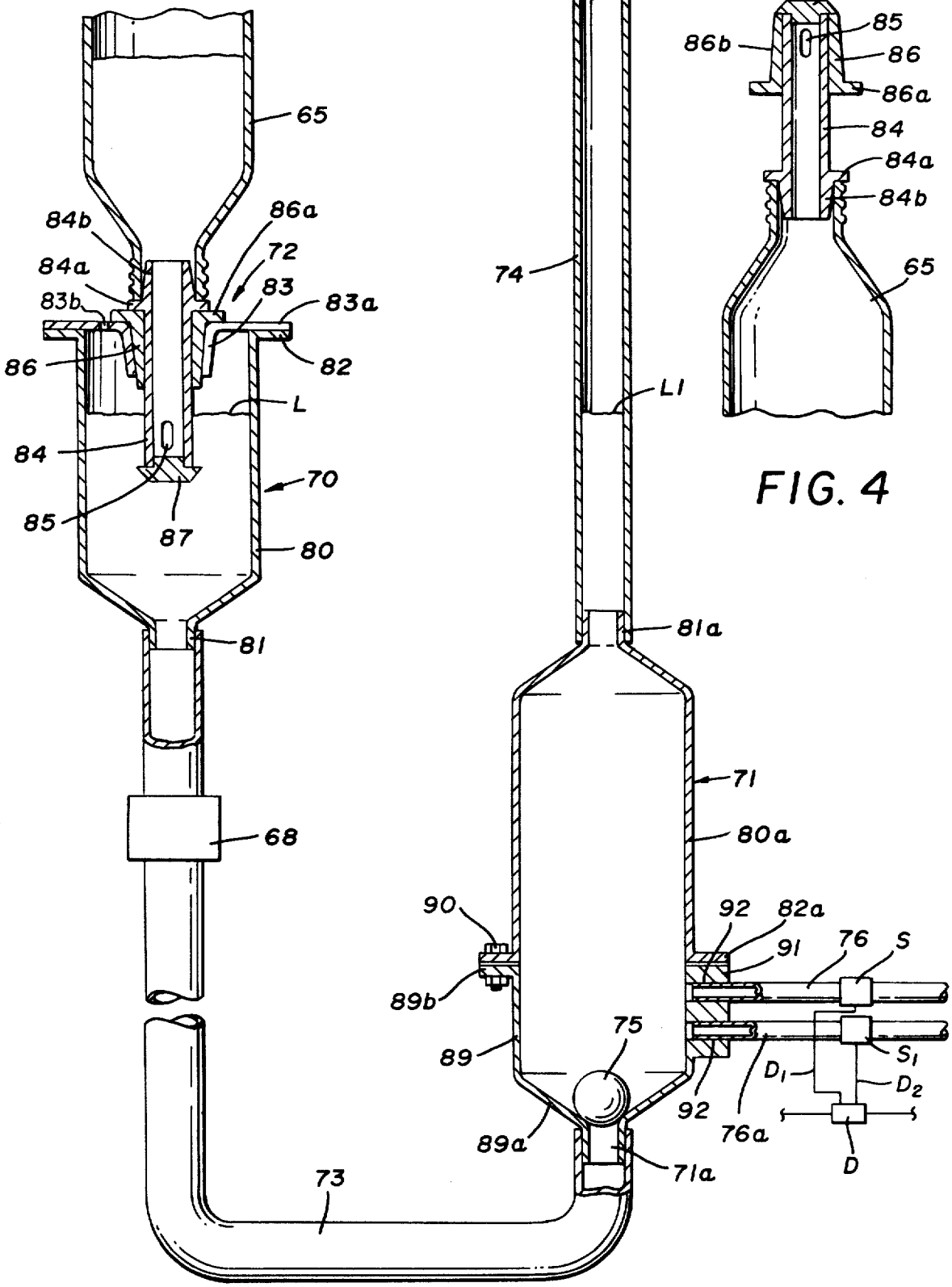
FIG. 3 is a sectional view enlarged and showing the pump dispenser that is utilized in connection with the dispensing of alcoholic beverages in the drink dispensing apparatus.
FIG. 4 is a view showing the position of the improved closure plug for an individual bottle prior to being installed in the reservoir as shown in FIG. 3.

The unique liquid dispensing means that are utilized to dispense alcohol in the improved apparatus are best shown in FIGS. 3 and 4 of the drawings. It will be noted that in each case the same include a filling reservoir 70 and a dispensing pump 71, with the reservoir 70 being adapted to receive a bottle adaptor means 72 which, in turn, receives a bottle such as the bottle 65 shown in FIG. 3 of the drawings. One such pump dispenser is employed for each of the bottles utilized in the alcohol dispensing mechanism 40.

The filling reservoir 70 and the dispensing pump 71 are shown connected in FIG. 3 by a conduit or tube 73, with a low level indicating means 68 being interposed in line 73 for purposes that have been previously discussed.

Further, a tube 74 is connected at one end to the upper portion of the dispensing pump 71, while the other end thereof is actively associated with the three-way solenoid valve 49 in the manner shown in FIG. 2 of the drawings.

A stainless steel ball 75 and a dispensing line 76 are also associated with the dispensing pump 71, with ball 75 serving to gravitationally seal opening 71*a*, while dispensing line 76 has interposed therein a solenoid S that is controlled by either diode D1 or D2 or both for the purpose of accurately controlling the amount of liquid that is discharged from the dispensing pump 71 upon actuation of the proper control therefor.

It is contemplated that the weight of the stainless steel ball can be varied as by making the same hollow, for example, so that the same can be unseated, as will be described, by bottles that are located at varying elevations above the same in the storage racks that are provided for this purpose.

As to the detailed construction of the filling reservoir 70, the same includes a unitary tubular member 80 having a reduced neck opening 81 at one end and a flange 82 provided at the other end, with the reduced neck opening 81 being received in water and air tight relationship within the tube 73 and with the flange 82 serving as a support for the bottle-adaptor means 72 as will now be described. Vent 80*a* is provided above the level of the openings 85,85, as positioned in FIG. 3, for the purpose of permitting the entrance of air into the reservoir 70 above the level of discharge through openings 85,85.

In this regard the bottle adaptor means include a circular disc 83 having an angularly depending (FIG. 3) circular boss that is seated upon the flange 82 as shown in FIG. 3 of the drawings for self-locating purposes. Received into the bottle 65 in the manner shown in FIG. 4 is another sleeve 84 that has a flange 84*a* and a tapered end portion 84*b* that is snuggly received in self-centered relationship to the neck end of the bottle 65. Openings 85,85 are provided in the upper (FIG. 4) end of the tube 84, and additionally, as will be noted in FIG. 4, a tapered locating sleeve 86, having a flange 86*a*, is telescoped around the exterior of the sleeve 84 so as to be positioned between sleeve 84 and locating disc 83 as shown in FIG. 3. The tapered surface 86*b* of sleeve 86 preferably is conical in nature and complemental to the interior surface 83*a* of the disc 83 as shown in FIG. 3. A cap 87 is fixed with respect to sleeve 84 so as to limit the axial movement of sleeve 86 between the flange 84*a* (as shown in FIG. 3) and the cap 87 (as shown in FIG. 4).

By this arrangement, when the bottle is in the position of FIG. 4, the contents thereof are prevented from emitting through the openings 85,85. However, when the bottle 65 is inverted and the sleeve 86 placed within the sleeve 83 and the bottle inserted within the disc 83, there will be a contact between the disc 83 and the sleeve 86 which will result in an upward movement (FIG. 3) so that the openings 85,85 are thus exposed to permit the contents to flow freely from the interior of the bottle 65 to the interior of the filling reservoir 70 from whence it can flow into line 73 when the system is activated.

As regards the dispensing pump 71, the same is of generally two-piece configuration, with the upper portion thereof (FIG. 3) including a unitary tubular member 80a that is preferably identical to and interchangeable with the previously described reservoir 80, with reservoir 80*a* also including a neck portion 81*a* and a flange portion 82*a*. The lower portion of the dispensing pump 71 includes a tubular casing 89 that has a tapered neck end 89*a* that terminates in the neck opening 71 previously described, with the opening 71 being inserted in the tube 73 in air and water tight relationship much in the same fashion that the tube 73 was connected to the neck end 81 of the resevoir 80.

The casing 89 also includes a flange 89*b* adapted to be secured, as by bolts 90,90, in fluid-tight relationship with reservoir 80*a* so that a fluid-tight reservoir is provided between lines 73 and 74.

The reservoir 89 also includes a boss portion 91 having a through bore 92 within which the dispensing line or lines may be received, with each dispensing line having provided therein a control solenoid 44 (see FIG. 1) so as to regulate emission from the dispensing pump by activation or deactivation of the solenoid 44 simultaneously with activation of the three-way solenoid 49 in the manner that will be described.

D. Operation and Use of the Fluid Dispensing Means

To use the dispensing means just described, it will first be assumed that a full bottle of fluid, such as alcohol in the bottle 65, had the cap removed therefrom followed by insertion of the tapered portion **84*b* of the sleeve 84 into the bottle opening as shown in FIG. 4** of the drawings.

At this time the flange 86 would be manually lifted so that the sleeve portion **86*b* thereof covered the openings 85,85 following engagement of the sleeve 86 with the cap member 87 as shown in FIG. 4**.

At this time the bottle can be inverted and the cap portion inserted through the opening of the centering disc 83, with surface **86*b* ultimately engaging surface 83*a* following which the sleeve 86 will slide relatively of the sleeve 84 until flange 86*a* comes into contact with the flange 83, at which time the bottle will be fully inserted in self-centered relationship within the reservoir 70, with the openings 85,85 thereof being opened so as to permit fluid to flow from the bottle 65 into the reservoir 70 and thence through neck opening 81 to tube 73 where the head pressure of such liquid will unseat the ball 75 and cause the entering liquid to seek its own level at a point indicated by the letters $L_1$ in FIG. 3 of the drawings, with it being noted that the level of $L_1$ is identical to the level L shown in association with the reservoir 70 in FIG. 3. Once this identity of levels has been attained, the ball 75 will, of course, seat to close off the neck opening 71 as shown in FIG. 3**, with the unit now being primed or otherwise filled for the purpose of dispensing drinks in the manner that will now be described.

In this regard when the proper key selector button has been activated, two things will simultaneously occur.

First, the three-way valve 49 would be operized to pressurize the interior of the tube 74 and exert a compressing pressure on the liquid in the pump dispensing means below the level $L_1$. Simultaneously therewith the solenoid S will be opened so that the pressurized liquid can emit from the dispensing means 71 through line 76 for the appropriate duration of time, with it being impossible for liquid to get past ball 75 because of the fact that the same is automatically seated thereon to block the exit of fluid to line 73 through neck opening 71.

When the appropriate time cycle has been completed, both the solenoid valve will be closed and the tube 74 will be opened to atmosphere, following which the head pressure on the liquid beneath the ball 75 will cause the same to be unseated and accordingly restore the liquid level to level $L_1$ as was previously the case.

It should be noted from FIG. 2 that while three different bottles **65*c*, 65*d*, and 65*e* are illustrated having varying liquid levels, in each instance an identical amount will be dispensed provided that the settings for the solenoid valves 44 and 49 are identical in each instance. Also it will be noted that the level $L_1$ will progressively diminish as the contents of the bottle 65 are emptied, and when the level reaches a level approximately half-way down the reservoir 70, there will be insufficient pressure upon the low level indicating means 68**, which is preferably in the form of a pressure indicating switch that will trigger when the pressure on it falls below a certain point.

As to size of the various reservoirs, this may be varied in accordance with individual tastes and size requirements, with it being practical to make the reservoirs 70 and 80 capable of holding anywhere from two to twenty-two ounces of liquid.

It also should be noted with regard to the pump dispensing means 71 that the ball 75, acting as it does on the inclined surfaces of the tapered portion 89a, actually constitutes a failsafe device which does not require perfectly vertical installation because of the inclined angle over which the ball will roll into the seated position shown in FIG. 3.

It is also possible by using this construction to have one solenoid valve 49 serve, through a manifold type of connection, several tubes 74,74 because of the fact that when the solenoid opens to let pessurized air into the lines 74,74, only the one will be activated where the solenoid 44 has been simultaneously actuated. The others will remain inactive because the liquid cannot escape past the ball 75 unless the solenoid 44 that is associated with the same has been simultaneously opened.

As to material for the containers and tubes described in connection with the liquid dispensing means, it is mandatory that this material be of a non-toxic inert material such as stainless steel or other high quality plastic materials that have been approved industry-wise for liquid transferring and sanitation purposes.

E. Connector Means

Figure 7:
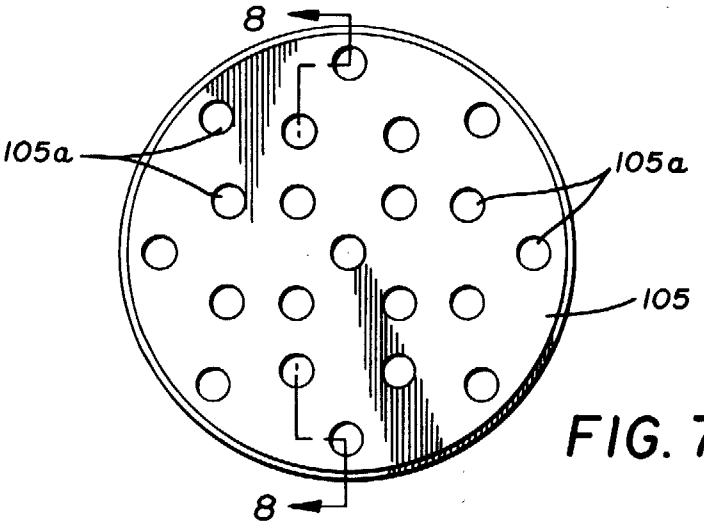
FIG. 7 is an end elevational view of the improved connector.
Figure 8:
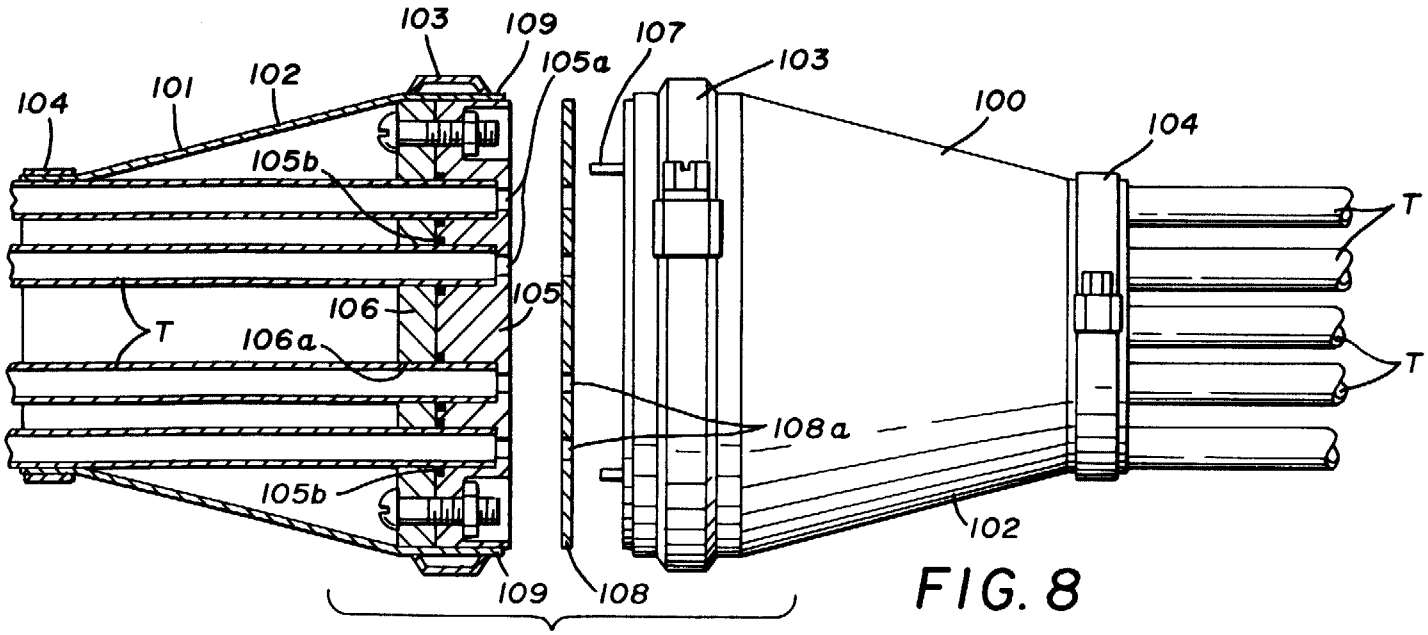
FIG. 8 is a view taken on the lines 8—8 of FIG. 7.

The unique and improved connector means that have been generally discussed above are best shown in FIGS. 7, 8, and 10 of the drawings and include male and female connector plates 100 and 101, with each plate having an outer casing or skirt 102 that extends between bands 103 and 104, with band 103 surrounding abutted plates 105 and 106 so as to firmly secure the skirts 102 positioned thereon as shown in FIG. 8. FIG. 7 is a typical elevation of the plates 105, 106, with the plate 106 being provided with appropriate holes **106*a*,106*a* therethrough for reception of the tubing members T as shown in FIG. 8. The projecting ends of the tubing members T are received in counterbored apertures 105*a*,105*a* of plate 105, with O-rings 105*b*,105*b* also being provided at the opposed end of the plate 105 for sealing purposes. In this regard it is important to note that the diameter of the smaller opening of the counterbore 105*a* is less than the diameter of the tube T inserted therein as shown in FIG. 8. By this arrangement it would be permissible to use tube T of one diameter with respect to the connector plate 100 and use another size of tubing with respect to the plate 101**, with flow being uniform because of the fact that the tubing is larger than the reduced diameter opening in each instance, which would preferably be identical and in alignment for proper flow purposes.

The construction of the member 100 is identical except that it is provided with locating pins 107 that register with the gasket 108 so as to form a fluid-tight connection.

It will also be noted that each plate of the components 100 and 101 includes an angular flange 109 that extends peripherally thereof so as to permit joining of the members 100 and 101 on opposite sides of the gasket by application of the usual well-known V-type compression clamp (not shown).

It is to be noted that the gasket 108 has openings 108*a*,108*a* that are in alignment with the small diameter openings of the counterbore 105*a*.

It will be seen from the above description that each half of the coupling member 44 is thus capable of quick connect and disconnect with respect to the other portion thereof, with the standard fastening means being employed to connect these two members together and with bolts B being employed to retain the plates in water-tight relationship with each other in each instance.

In use or operation of the improved coupling, it is merely necessary that the component parts have been assembled in the manner heretofore indicated, at which time the same can be assembled and retained together in fluid-tight relationship.

F. The Hydraulic Accumulator

As indicated aforesaid, an important feature of the invention is believed to reside in the provision of means for preventing drippage during periods of non-use.

Figure 9:
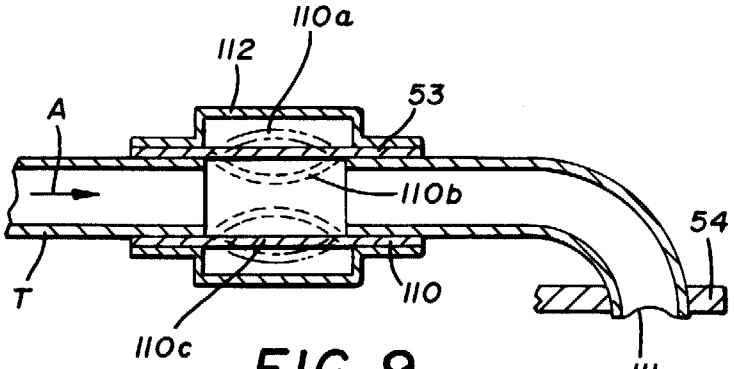
FIG. 9 is a sectional view showing the hydraulic accumulator.

The provision for such a feature is found in the sectional view of FIG. 9 wherein a typical dispensing tube T is shown terminating at a point within the schematically illustrated pouring head 54. It will be remembered in connection with FIGS. 3 and 4 that liquid under pressure will be entering the hydraulic accumulator 53 in the direction of arrow A in FIG. 9 of the drawings.

This is true because it will be recalled from FIGS. 3 and 4 that pressure from the three-way solenoid valve 49 will be entering line 74 and causing the liquids in reservoir 71 to emit rapidly through line 76. Surrounding the split portions of the tube T in telescoped relationship therewith is a relatively flexible sleeve 110 that preferably is of a material that will yield under the pressure to a greater extent than the tubing T. This sleeve 110 will be secured around tube T in conventional fashion as by the use of adhesives or the like.

Also surrounding the sleeve 110 is a rigid contoured sleeve 112 preferably of non-resilient material which will, in effect, limit or serve as a cage that will limit the expansion of the sleeve 110 in a manner that will be described.

It will also be noted that three positions are shown with respect to the sleeve 110 in FIG. 9 of the drawings, with the chain-dotted line position 110*a* indicating the condition of the sleeve during the surge of pressure, the dotted line position 110*b* indicating the position immediately following cutoff of the pressure, and with the full line position 110c indicating the normal position of the tubing.

Because of the continuing influence of this vacuum, the liquid would be retained in the position shown by line 111 indefinitely so as to eliminate dripping.

G. Pouring Head

The pouring head is best shown in FIGS. 11 and 12 of the drawings.

Accordingly and referring to FIGS. 11 and 12, the pouring head includes a circular sleeve 121 that surrounds the tubes T that have been placed together in close proximity as shown in FIG. 11, with the previously discussed connector means having facilitated such an arrangement.

In the preferred embodiment the tubes in the pouring head will preferbly be of a slightly smaller diameter than the supply tubes leading from the blow line to the connecting means. This is done for the reason that additional line pressure will be created in the supply lines. This additional line pressure will automatically create additional back pressure in the supply lines to permit operation of the hydraulic accumulator in the manner just described.

A unique feature of the pouring head shown in FIGS. 11 and 12 is the provision of a sub-pouring head 120 that is particularly adapted to the pouring of syrups in that is provides a unique mixing feature and eliminates the possibility that the syrups could contaminate or otherwise interfere with the alcohol dispensing tubes that are adjacent thereto.

In this regard, it will be noted that this sub-pouring head 120 is shown in the preferred embodiment as being of octagonal configuration in plan and further that the same extends down below the lower edge 121*a* of the sleeve 121 as shown in FIG. 12 of the drawings.

Also and as will be noted from FIG. 11, the innermost tubes 122 and 122*a* are preferably arranged in the center and preferably carry the carbonated water to this pouring point. Surrounding the members 122 and 122*a* are a series of syrup dispensing tubes 123, 123, each of which is preferably bent in at its dispensing end as at 123*a*,123*a* (see FIG. 12).

By this arrangement fluid emitting from the tube 123, for example, as shown in FIG. 12 in the direction of arrow 123*b* will automatically admix with carbonated water emitting from the tubes 122 and 122*a* in the direction of arrow 122*b* in FIG. 12 of the drawings.

H. Cream Cooling System

It is generally preferable in connection with the dispensing of creams to have the same chilled so that congealing of the same will be avoided.

To this end and as best shown in FIG. 10, the cream tank or perishable reservoir 41 is shown in FIG. 10 as being associated with air compressor 59 so that cream, for example, may be dispensed through line 52*b* to solenoid 45 and thence to dispensing head 55 as schematically illustrated in FIG. 10.

A cooling system can be associated with this just described basic system as shown in FIG. 10 with the system including a refrigeration plate 140, a water tank 141 both of which are received in an ice bin 142 along with the cream reservoir 41 as clearly shown in FIG. 10 of the drawings. A pump 143 is also associated with the unit.

Fittings 144 and 145 serve to receive both the line 52*b* and an outer surrounding line 146 as shown in FIGS. 10 and 10*a* of the drawings with the fittings serving to permit the line 52*b* to be enveloped within the line 146 while permitting the flow of liquid between these two lines as shown in FIG. 10*a*.

To this end, a line 147 leads from fitting 144 into the refrigeration plate 140 from which a line 147*a* will carry the fluid into the intake side of the water tank 141. Line 147*b* connects the reservoir 141 with the pump 143 whereupon the water is carried through line 147*c* into the fitting 145 for retransmission around the line 52*b* to the fitting 144 to thus complete the flow circuit of the water.

By this arrangement, water from the reservoir 141 is continuously recirculated through a system that will chill the same and pass around the cream being dispensed so as to constantly keep the same chilled during the period of dispensing.

I. Head Switch Assembly

Schematically in FIG. 1 of the drawings, the head switch has been indicated by the numeral 56.

The detailed construction of the head switch assembly, however, is best shown in FIGS. 13, 13*a* and 13*b* which will now be described in detail.

Accordingly and referring first to FIG. 13, it will be noted that the switch assembly includes a main bracket 160 that includes an arched surface 161, 161*a* that extends on opposed sides of a pocket 162 within which a switch member 163 may be slidingly received with the switch member being retracted in FIG. 13 to the closed position of FIG. 13*b* indicating the position of the switch in the "open" or inactivated position.

Switch member 163 has a tapped aperture 163*a* within which the threaded portion 164*a* of a stud member 164 may be received, with spring 165 surrounding the portion of the stud adjacent the threaded portion 163*a* so as to bear against the one face of the bracket 163 as clearly shown in FIG. 13*a* of the drawings.

A mounting unit 166 of right angle configuration also serves to support a sleeve 167 having a bore 167*a* and a counter bore 167*b*, with spring 165 seating against the wall defined by the counterbore 167*b*.

The rear portion 163*b* of bracket 163 also carries a set screw 168 that will serve to engage the contact end 164*b* of the stud 164 as shown in FIG. 13*a*, with FIG. 13*a* representing the closed position of the switch. A circular flange 169 is also provided on stud 164 so that the same may engage the bracket 166 when the same returns to the open position of FIG. 13*b* by virtue of the expanding forces exerted by the spring 165.

It is also to be noted that the switch member 163 has a contoured surface 163*c* that is arcuate in nature.

The purpose of the surface 163*c* is that the same will require that the glass or cup being used to collect the drink upon being dispensed will have to be centered with respect to the surface 163*c* before the same can be depressed to the position of FIG. 13. The contour of the surface 163*c* is such that all sizes of glasses will be accommodated by the same with this serving as a centering device that will automatically locate the glass in proper alignment below the dispensing head so as to avoid spilling of the drink during the period that the same is being dispensed.

Finally and as shown in FIGS. 13 and 14*a*, electric lines 170 and 170*a* are connected respectively to the screw 163*b* and the contact end 164*b* of the stud 164 so that when the same are in contact with each other as shown in FIG. 13*a*, the same will be energized in known fashion.

J. Glass Size Selector Means

In the dispensing of drinks, it is helpful to an unexperienced bartender to know the proper size glass to be used for any given particular drink. This avoids the common problem of underpour and overpour and generally, glasses fall into the categories as shown in FIG. 13*c* of Rocks glasses 180, Collins glasses 181, Sour glasses 182 and Manhattan and Martini glasses 183.

It will be noted from FIG. 13*a* that the righthand portion of the sheet includes various mixed drinks such as Alexander, Dacquiri, Gibson, Pink Squirrel and the like and it will be noted that in each instance, the proper glass to be used is shown associated with the drink in question. Thus, when a bartender is asked for a "Rusty Nail" for example, he knows that he should use a Rocks glass 180. Likewise, when a Screwdriver is ordered, a Collins glass 181 will be employed.

On the top row of the lefthand portion of the drawing shown in FIG. 13*c* are shown the major ingredients of most drinks with Whiskey, Bourbon, Scotch, Gin and Rum being shown. It will also be noted that under each major ingredient just described there is shown a particular brand.

Thus, if a person wishes VO on the rocks, it will merely be necessary to depress the Seagram VO button associated underneath the panel together with the Rocks button indicated by the numeral 180. By like token, if a Beefeater Martini was desired, it will merely be necessary to depress the Beefeater and Martini buttons at which time, the drink should be dispensed.

It will be seen that this permits a pre-sized selection of drinks together with advising the operator of the glass to be selected.

It will also be noted that additional control buttons or function buttons are provided in the form of the soft drink button 184, the splash button 185 and the repeat button 186, the cash button 187 and the charge button 188, with these controlling the operation of the machine that has been and will be described.

Prime button 189, wash button 190 and clear button 191 are also provided for this purpose.

It will be apparent from the above that the panel sheet can be programmed for each individual operation dependent upon the requirements of the particular user.

DETAILED DESCRIPTION OF THE CIRCUITRY KEYBOARD

As was mentioned hereinabove, the keyboard comprises a plurality of pressure actuated switches, each switch designating either a component of a mixed drink, a total composite drink, or a functional operation. Although the keyboard may take any of numerous configurations, it is preferred that the switches be arranged in rows and columns so as to have a neat and orderly appearance while being readily adaptable for implementation with circuitry to be described hereinbelow. As is shown in FIG. 6, the keyboard may be readily arranged in a matrix comprising 16 columns and 7 rows with the first six rows representing drink components or compositions and the seventh row providing the function selections available to the bartender.

Common to each of the switches in any given column in the keyboard is a column line and similarly common to each of the switches in a given row is a row line. Consequently, there are 16 column lines and 7 row lines in the configuration shown in FIG. 6. The depression of any given switch on the keyboard connects the column and row line common thereto. For instance, the depression of the "Collins" switch will interconnect row line 7 and column line 2, while the depression of the house bourbon switch will interconnect column line 2 and row line 1. The importance of this interconnection will become apparent directly hereinafter when consideration is given to the keyboard interface.

KEYBOARD INTERFACE

The interface 30, as shown in FIG. 1 actually comprises two sections which will be dealt with separately herein. The first portion of the interface, the keyboard interface, receives data from the keyboard, decodes and stores the same, and relays indicia of the decode and storage function back to the keyboard.

The basic component of the keyboard interface is shown in FIG. 14 to comprise a clock generator which provides the basic timing functions required. A 100 khz crystal oscillator is sent to a divide by 10 decode circuit so as to create a 10 khz signal and the interleaved timing signals TA, TB, and TC. The 10 khz output of the decode circuit is shown in FIG. 15 to drive a binary counter having outputs V01 - V07. The most significant output bits of the binary counter, V05 - V07, drive the inputs of the one of ten decoder I. The outputs of the one of ten decoder I, R1 - R7, are connected to the row lines discussed hereinabove in relation to the keyboard of FIG. 6. Thus, signals are evidenced on the row line of the keyboard in accordance with the outputs of the binary counter.

The three least significant bits, V01 - V03, of the binary counter are supplied to the address lines of data selectors I and II. The V04 output of the binary counter is connected to the disable input of the data selector I and through an inverter 300 to the disable input of the data selector II. Consequently, depending upon the count of the binary counter, one of the other of the data selectors will be enabled. Since the two data selectors are alternately enabled, their outputs, Z, are wire-ORed together and fed to the 64 × 1 solid state RAMS as will be discussed below.

It should now be apparent that the binary counter will address all possible combinations of row lines and column lines as it steps through its binary count. If one of the buttons of the keyboard has been depressed, as discussed hereinabove, that count of the binary counter corresponding to the interconnection of the row line and column line associated with the button, will result in an output signal at the appropriate time and from the appropriate data selector. The timing of this output signal with relation to the output of the binary counter indicates specifically that button which has been depressed. The outputs of the data selectors are passed to the inputs of two 64 × 1 solid state random access memories (RAMS). The addressing of the SS RAMs is controlled by the binary counter. The V07 signal, connected directly to one of the memories and through an inverter 302 to the other, alternately enables and disables the two memories. Consequently, there is associated with each particular intersection of a row line and column line on the keyboard a particular data storage bit within the memory system. In other words, each button of the keyboard has an associated data storage location within the memory. The binary value stored within each data storage bit is evidenced at the output of each of the memories as the particular address is accessed. This value is applied to the NAND gate 304 which is gated with TC through the inverter 305 to create the signal $D_o$ which will have the same binary value as the data storage bit. The utilization of the $D_o$ signal and other control functions related to the memory will be discussed later with respect to the control card. Suffice it to say at this time that the memory will store a value in each of its data storage locations in accordance with the state of actuation of the associated switch on the keyboard.

Also receiving the same column addressing signals as the data selectors I and II are two one of ten decorders, II and III, which produce outputs C1-C16 corresponding to the particular column line which is accessed by means of the data selectors I and II. The one of ten decoders II and III, are alternately enabled as are the data selectors by means of the application of the signal V04 and the complement thereof respectively to the NAND gages 306 and 308 which are appropriately gated with the signal TC. Consequently, there is provided a plurality of signals, C1-C16, actuated in association with the accessing of each of the column lines of the keyboard.

Associated with each of the switches of the keyboard is a light emitting diode (LED). As is best illustrated in FIG. 16, a plurality of row LED lines and column LED lines are associated with the keyboard shown in FIG. 6. Interconnected between the row and column LED lines at each switch position is a light emitting diode. The LED is suitably positioned with respect to the switch with which it is associated either above or below the same. The circuitry shown in FIG. 16 is illustrated in detail only with respect to one LED, that LED being the one associated with the switch located in row 1 and column 1. It is to be understood, of course, from the dotted lines, that a plurality of identical circuits will be utilized to achieve the total LED matrix. There would be 16 identical circuits associated with the column LED lines and 7 identical circuits associated with the row LED lines. Of course, the row and column circuits are different as is illustrated in the schematic. It can be seen that each of the column LED lines is connected to the + V supply by a gating transistor 312. The application of power to the column LED line is conrolled by one of the signals C1-C16 applied to an appropriate inverter 310 which applies a corresponding signal to the base of the transistor 312 through the resistor 314. The signals C1-C16 are the outputs of the one of ten decoders I and II of the schematic of FIG. 15. It can be seen then that each time a column line is accessed by the data selectors I and II, power is supplied to the corresponding column LED line. The column LED lines are connected to each of the row LED lines at each point of intersection by means of a LED as shown. As each of the row lines of the keyboard is accessed by the outputs R1-R7 of the one of ten decoder I, an associated transistor 320 is gated on by means of the application of one of the signals R1-R7 to the base thereof through a driver 316 and resistor 318. As the addressing of the row and column matrix of the keyboard and memory is achieved as discussed with regards to the circuitry of FIG. 15, the various LEDs are caused to conduct through the transistors 312 and 320 the resistor 322 and a resistor 324 to ground. The resistor 324 is of such an impedence as to result in a small current flow through the LEDs as the same are accessed so that only a slight glowing appearance results. If a button on the keyboard has been depressed, then, when the address of that button is reached by the relationships of the signals C1-C16 and R1-R7, there will be a $D_o$ signal from the memory applied to a driver 326 which, through the resistor 327, gates the transistor 328 into conduction shunting the resistor 324. Consequently, there is a greater current flow through the LED associated with that button and the LED is caused to glow considerably brighter. Thus it can be seen there will be evidenced at each actuated button a brightly glowing LED indicating not only that the switch has been depressed, but that data evidencing that fact has been stored in memory.

The column address lines C1-C8 from the one of ten decoder II are respectively fed to the NAND gates 330-337 as shown in FIG. 17. The C1-C8 signals are gated with the data signal $D_o$ to the data input of the 8 decoders shown. There are 8 such decoders, one for each of the first 8 columns of the keyboard matrix of FIG. 6. Each decoder has 6 outputs addressable by the application of the signal VO5-VO7 to the A, B and C inputs thereof. If the data input of the decoder is at a logic 1 level, then the output addressed on the A, B and C lines will be pulsed to a one level. Since the addressing of the decoder outputs is from the same signals which select the rows of the keyboard matrix through the one of ten decoder I, it becomes obvious that the outputs of the decoders 1–8 are representative of switch positions on the keyboard. For example, if the rum button in column 6 and row 3 of the keyboard is depressed, then a $D_0$ signal will be coincident with a C6 signal whenever the VO5 - VO7 signals binarily select output 3 of the decoders. Consequently, the coincidence of all the signals will result in the output 3 of the decoder 6 being at a logic one during the period of such coincidence. It should be clear that each time the address of an actuated switch is achieved by the combinations of signals VO5 - VO7 and Cl-C8 a pulse will be emitted from the appropriate decoder.

Thus it should be apparent that the outputs of the decoders 1-8 each particularly relate to a row address, a column address, and the presence or absence of actuation of the selector switch at that row and column address. The output of the decoders 1-8 are logically combined through NAND gates with associated time functions. The time functions vary as will be discussed hereinbelow in accordance with the particular type drink associated with the button actuated. For example, the soft drink (SD) time interval associated with all the buttons of column 5 and the buttons of row 6, columns 4 and 6, have a different time interval or dispensing cycle than do the cordials of column 8 and column 7, rows 4–6. The outputs of the NAND gates go to either the program board, designated by the X's and to be discussed later, or through inverters and diodes to the solenoid drivers which control the opening and closing of the dispensing valves discussed hereinabove. It should however be clearly apparent from the description of the keyboard interface that actuation of a button or buttons on the keyboard will, through the keyboard interface, appropriately select the solenoid or solenoids to be actuated for dispensing the proper components and will, under appropriate controls to be discussed hereinafter, allow the dispensing to be performed for a predeterminable amount of time.

As can be seen from FIG. 17a, which elaborates on the circuitry of FIG. 17, the outputs of the decoders 1–8 are gated with a time function in a NAND gate. The output of the NAND gate is inverted and operatively passed to the cash category counter, which will be discussed hereinafter, and also through a diode to a solenoid driving circuit. The driving circuits for the solenoids of the invention are fundamentally Darlington circuits as shown; the Darlington circuits being gated "on" by the pulses from the associated decoder. In order to maintain constant application of power to the solenoids through the Darlington circuits, a capacitor and resistor are interposed between the diodes and gating transistors thereof. The capacitor holds the charge of the pulses from the decoder and applies the same through the resistor to the Darlington thus achieving a continuous application of solenoid power during the entire time period dictated by the time function notwithstanding the fact that pulses, rather than levels, are emitted from the decoders 1-8.

PATCHBOARD OR PROGRAM BOARD

A particularly unique attribute of the invention is the programability thereof. While the left side of the keyboard, as discussed hereinabove, allows the bartender to mix any of various components into a given drink, the righthand side of the keyboard is programmable so that particular mixed drinks may be programmed by means of appropriate connections made on the patchboard.

As can be seen in FIG. 18, there is provided in association with the righthand side of the keyboard, another 8 decoders numbered 9-16 which correspond to each of the columns 9-16 of the keyboard matrix. Each of the decoders 9-16 has, similar to the decoders 1-8, row input gating VO5-VO7. Column selection lines C9-C16 are gated with the Do signal through NAND gates 338-345 to the data inputs of the respective decoders 9-16. Consequently, as discussed hereinabove, the respective outputs of the decoders correspond to a row address, a column address, and the presence or absence of switch actuation at the particular address. Each of the outputs of the various decoders 9-16 have associated therewith jumper positions or patchboard connections for selecting the price category and component composition to be associated with each of the particular buttons on the right side of the keyboard. Although the purpose of the jumpers or patch connections will become more apparent, it should be briefly mentioned at this time that the buttons in columns 9, 10 and 11 may have two components comprising a drink, columns 12, 13 and 14 may have four components in a drink, and columns 15 and 16 may have six components in a drink. There is one jumper position or patch connection provided at each output for interconnection with pricing circuitry to be discussed hereinafter.

The outputs of the decoders 9-16 may be patched into circuitry similar to that shown in FIG. 19*a*. The particular circuitry shown is connected to the house blend solenoid driver which, responsive to control signals, controls the dispensing of the house blend liquor. As can be seen, the circuitry of FIG. 19*a* associated with the house blend solenoid driver, comprises four NOR gates 346-349. Each of the NOR gates has four inputs which may be patched into from the outputs of the decoders 9-16. The outputs of the NAND gates 346-347 respectively drive through inverters 350 and 351 to the inputs of NAND gates 352 and 353. The other inputs of the NAND gates 352 and 353 are connected to patch pins $T_x$ and $T_y$. The outputs of the NOR gates 348 and 349 are logically combined in the normal manner by means of the NAND gate 354 and applied to the input of the NAND gate 355 which has an input thereof connected to a timing patch point $T_z$. The outputs of the NAND gates 352, 353 and 355 are fed into the inputs of the NAND gate 356. Also comprising an input to the NAND gate 356, and designated by the X, is the signal associated with the output 1 of the decoder 1 shown in FIG. 17. The output of the NAND gate 356 drives through a diode to the house blend solenoid driver. Thus, with a logic 0 on any of the inputs of a NAND gate 356, the house blend solenoid will be actuated by the house blend solenoid driver so as to dispense the house blend for an amount of time determined by the associated time interval $T_x$, $T_y$, $T_z$ or the time interval associated with the first output of the decoder 1 of FIG. 17. As will be discussed hereinafter, there are 8 time intervals provided which may be patched into the terminals $T_x$, $T_y$ and $T_z$ for the preprogramming of mixed drinks. The time interval for which the solenoid will be actuated with respect to the input of the NAND gate 356 coming from the decoder 1 of FIG. 17 will be discussed hereinafter.

It should be apparent at this point that there is a logic circuit similar to that shown in FIG. 19*a* associated with each of the solenoid drivers of the various component drinks available in the system. The outputs of the decoders 9-16 may have their component patch pins connected to any of the patch pin inputs of the NOR gates 346-349. Appropriate timing intervals will be patched to the timing inputs $T_x$, $T_y$ and $T_z$. Thus, if the drink designated by the switch in column 9, row 1 were to require the dispensing of house blend for a period of time $T_y$, then one of the component patch pins connected to the output 1 of the decoder 9 would be jumpered or patched to one of the patch pins on the input of the NOR gate 347. Of course, the time interval $T_y$ would be a specific time interval and that patch pin would be jumpered to an appropriate time interval patch point, the creation of which will be discussed hereinafter. Thus, the input of the NOR gate 347 would be gated with a $T_y$ time interval signal which, through the NAND gates 353 and 356, would cause the house blend solenoid driver to dispense the house blend for a period of time equal to $T_y$.

The other component patch pins associated with the first output of the decoder 9 could be attached to another circuit similar to that shown in FIG. 19*b*. This circuit controls the actuation of the Vodka solenoid driver. If the other component patch pin of the first output of the decoder 9 were patched to an input of the NOR gate 358, then the Vodka solenoid driver would be actuated for a time period depending upon the patching of the time interval $T_{x1}$. Again, this could be for a period of time equivalent to any one of eight time periods and is totally selectable and programmable. Thus it can be seen that depression of the switch in column 9, row 1 will provide a mixed drink of house blend and Vodka in proportions dependent upon the relationship between the time intervals $T_y$ and $T_{x1}$. The input to the NAND gate 362 which is tied to the X would be connected to the X associated with output 4 of decoder 4 shown in FIG. 17.

It should be readily apparent that there will be a circuit similar to that shown in FIGS. 19*a* and 19*b* associated with each of the solenoid drivers regulating the dispensing of the various liquids available as components in mixed drinks. All of the circuits are fundamentally the same, providing patch points to be connected with the various outputs of the decoders 9-16 and time interval patch points to be connected to the time functions to be discussed hereinafter. The complexity of the circuits utilized and the number of patch point inputs thereto will be dependent upon the frequency of use of the component in various mixed drinks.

Also on the program board are a plurality of expandable OR gates as shown in FIG. 20. The outputs of the OR gates are connected to cash category counters which will be discussed hereinafter. The input of the OR gates are connected to the appropriate price patch pins connected to the outputs of the decoders 9-16. In other words, depending upon the price of the particular drink to be dispensed by actuation of one of the switches on the righthand side of the keyboard, the price patch point on the output of the decoder will be attached to an input of the OR gate going to the appropriate cash category. Thus, when a drink is selected on the right side of the keyboard, the signal is sent through the appropriate OR gate to the cash category counter associated with the value of the drink dispensed. Also, patched as inputs to the cash category OR gates are the outputs of the decoders 1-8 as shown in FIG. 17*a*. Again, the outputs of these decoders are patched to the appropriate OR gate associated with the proper price category such that, upon the start of a pour cycle, the prices of the various components of a drink selected from the left side of the keyboard may be summed together so that the total price of all the components utilized in the drink may be ascertained. This operation will be discussed in detail hereinafter but is presented here for purposes of brief description.

PRICE DISPLAY

A particularly unique attribute of the instant invention is the provision of a price display monitor which displays the aggregate price of all components utilized in mixing a particular drink and further displays, at the end of a total serving to a customer, the total price for all drinks purchased.

The actual visual component of the display apparatus comprises a liquid crystal display having an AC drive. As can be seen in FIG. 21, data representative of the price is received from the cash and control circuit to be discussed hereinafter and is clocked into four 4-bit shift registers under the control of a clock signal generated by the circuitry of FIG. 31. The outputs of the 4-bit shift registers are binary coded decimal, with one such register being associated with each of four positions in the monetary scale giving a total capability of registering 99.99 dollars. Associated with each of the 4-bit shift registers is a BCD to 7 segment decode element provided for purposes of transforming the data from the shift register into a usable form for the liquid crystal display.

The outputs of the BCD to 7 segment decoders are applied to the array of exclusive OR gates located directly therebelow. The liquid crystal display unit utilized in the instant invention requires that a voltage differential be present between the back plane and the front segments which change from an optically opaque to clear state to produce the output indicia. To this end, the back plane is driven by the 50 cycle 50% duty cycle (50/50) clock and the front segments are driven by the 50/50 clock through the exclusive OR gates as shown. The actuation of the display unit then occurs because of the out of phase characteristic between the data gated through the exclusive OR gates and the 50/50 clock exciting the back plane. The decimal point is operated by the complement of the 50/50 clock coming through an inverter 370 so that the decimal point is constantly actuated since the front plane thereof is always out of phase with respect to the back plane.

The liquid crystal display utilized to achieve the techniques of the instant invention is well known in the art. It is preferable that two such displays be utilized in back-to-back relationship with a translucent light diffuser interposed between the two. The displays are connected as above in parallel and hence price information is made available to both the customer and the bartender or operator.

TIMER

As was mentioned hereinabove, there are 8 timing periods provided in the system for the dispensing of various drinks. The amount of each component dispensed in a mixed drink is determined by the time period for which dispensing is allowed. The basic time periods T1-T8 are generated by the circuitry shown in FIG. 22. As can be seen, a 1 mhz crystal oscillator drives through a CMOS logic inverter connected as an operational amplifier 371 into a string of divide by 10 decode dividers. The output of the fifth divide by 10 decode divider is a 10 hz pulse which is applied to the input of a combination of two more such dividers 372 and 373. The divider 372 has 10 outputs corresponding to one tenth of a second increments. The divider 373 utilizes 5 outputs having one second graduations associated therewith. A plurality of manually selectable rotary switches 374-381 are operatively connected to the outputs of the decoder 372 allowing the selection of one of the 10 outputs thereof. The selection made by means of the rotary switches 374-381 are logically combined in the NAND gates 382-389 with one of the outputs of the decoder 373.

The outputs of the NAND gates 382-389 are applied through NAND gates 390-398 to the reset inputs of the quad flip flops 399 and 400. When a drink is to be dispensed as indicated by actuation of an ENABLE signal which is the ONE FRAME signal generated by the circuitry of FIG. 24 to be discussed hereafter, the quad flip flops 399 and 400 are set by application of pulse through the set inputs. All the outputs of the flip flops 399 and 400 are then in a logic 1 level. The ENABLE pulse also actuates the divide by 10 decode dividers and begins the counting of the decoders 372 and 373. As the various times selected by the rotary switches 374-381 and the interconnections of the NAND gates 382-389 with the decoder 373 are achieved, the flip flops are appropriately reset. Thus, the timing cycles T1-T8 are created. As can be seen, the timing cycles T1 and T2 may be in duration from 0 to 0.9 seconds, T3 and T4 from 1 to 1.9 seconds, T5 and T6 from 2 to 2.9 seconds, T7 from 3 to 3.9 seconds and T8 from 4 to 4.9 seconds. Thus it can be seen that a high degree of selectivity of dispensing cycles is achievable with the instant invention and the timing cycles may be readily programmed by use of the rotary switches to achieve the desired timing cycles. It should be briefly noted that a reset signal may be applied through the inverter 401 to the set inputs of the flip flops 399 and 400 and to the decoders 372 and 373. This reset pulse initializes the decoders and resets all the flip flops when power is initially applied so as to prevent improper operation of the system. The reset pulse is the POP pulse to be discussed hereinafter in regards to FIG. 33.

SYSTEM CONTROL AND CASH CALCULATOR

As shown in FIG. 5, an important part of the electronic control system is achieved by means of the system control and cash calculator electronics. Referring now to FIGS. 15, 23 and 24 in unison, the control circuitry for reading and writing keyboard information into the 64X1 solid state RAMS may be understood. The $D_i$ and $D_o$ signals associated with the RAMS are fed to the exclusive OR gates 402 and 403 which are operative to set the state of the flip flop 404. If there is a data input signal $D_i$ but no data output signal $D_o$, indicating that the state of the switch actuated has not been stored in memory, then a clock pulse from the NAND gate 405 will set the state of the flip flop 404 so that at time TB the RAM memory will be switched, through the NAND gate 406 to the write mode.

The strobe signals necessary for strobing the data into the memory when it is in the write cycle are created by the circuitry shown in FIG. 24. Here it can be seen that two strobe signals, strobe 1 and strobe 2, are created so that there is one strobe for each of the two memories as shown in FIG. 15. The signal VO7 is operative to alternately enable the two RAMS of FIG. 15 and are similarly operative through the inverter 407 to alternately control the strobes 1 and 2. Hence, it should be readily apparent that the circuitry of FIGS. 23 and 24 so interrelate with the RAMS of FIG. 15 as to store data therein recording the fact that particular buttons on the keyboard have been actuated.

When the components of a particular drink have been selected on the keyboard, the operator may open a normally closed pour switch by placing a glass or other receptacle under the dispensing head. As can be seen in FIG. 25, when the pour switch is opened by a glass, indicating that a pour cycle is being entered into, the pour switch applies a 1 to the J input of the flip flop 410. A $\overline{D}$ pulse from the circuitry of FIG. 23 which indirectly indicates the presence of stored data in the memory, sets the flip flop 410 and applies a 1 to J input of the flip flop 412. The NAND gates 414 and 416 receive as inputs the signals VO1-VO7 which are the scanning inputs of the keyboard. The NAND gates 414 and 416 drive the NOR gate 418 which in turn drives the inverter 420 which creates the clock pulse for the flip flop 412. Consequently, the flip flop 412 is clocked at the end of a complete scan cycle of the entire keyboard. With a 1 present at the J input of the flip flop 412, the Q output goes to a logic 1 (the POUR signal) indicating that a pour cycle has been entered into.

The outputs of the flip flop 412 are gated through the NAND gates 414 and 416 which are operative through the inverters 418 and 420 respectively to control the transistor and light emitting diode circuit as shown. When a pour cycle is entered into the flip flop 412 is set, it should be readily understood that transistors T1 and T4 conduct thus passing current through the green LED. When data has been entered so as to set the flip flop 422 and the pour switch has not been actuated, the transistors T2 and T3 are set in a conducting state so as to pass current through the red LED. The green and red LEDs are positioned visibly adjacent the pouring head and respectively indicate the dispensing or non-dispensing of beverage.

The flip flop 410 stays set until removal of the glass from below the pouring head at which time it is reset through the inverter 426. The flip flops 422 and 424 are connected together with the Q output of the flip flop 424 resetting the flip flop 422. The outputs of the flip flop 422 take their respective states for a period of time equivalent to one scan of the keyboard or in other words, the count of 128 by the signals VO1-VO7. The output of the flip flop 424 is a one shot occurring once during each such scan.

The ONE FRAME pulse coming from the Q output of the flip flop 422 of FIG. 31 is applied to the enable inputs of the counters shown in FIG. 26. In other words, these counters are enabled for a period equivalent to one scan of the total keyboard. Each of the eight counters shown has associated therewith a particular price or value (a cash category). The clock inputs to the counters are the outputs of the expandible OR gates as shown in FIG. 20. Consequently, during a complete scan of the keyboard those buttons on the keyboard which are depressed will register that fact in the appropriate counter by clocking that counter through the corresponding OR gate when the position of that button on the keyboard is addressed as shown in FIG. 17*a*. The buttons on the keyboard, representing drinks or components of drinks, will have associated therewith particular values. The value of the drink dispensed will depend upon the aggregate of the weighted values of the buttons selected. Consequently, during a scan of the keyboard (the ONE FRAME pulse), appropriate counts are made into the various counters of FIG. 26 indicating the number of times that components of particular value are used in formulating the drink dispensed. At the end of one scan of the keyboard then there is contained within the counters indicia of a total value of the drink to be dispensed.

The outputs of the cash category counters as just described are applied to the multiplexers 1–3. The outputs of the cash category counters are in binary form with the least significant bit thereof applied to the multiplexer 1, the second bit applied to multiplexer 2, and the most significant bit being applied to the inputs of multiplexer 3. As can be seen, all of the outputs of each cash category counter are applied to similar inputs of the three multiplexers. The multiplexers are addressable over the address lines A, B and C. The address applied to the multiplexers is effectively then the address of a particular cash category counter. The outputs of the multiplexers are respectively labeled B1, B2 and B3 and indicate in a binary form the number of times each price category was used in formulating a particular drink. It should be apparent that each price category could be used as many as seven times in formulating any given drink.

Each time an address is applied to one of the multiplexers 1–3, the same address is applied to the one of ten decoder IV on its address lines A, B and C. As can be seen, the outputs of the one of ten decoder IV are connected to an array of thumb wheel switches, which are binary coded decimal selector switches, indicated generally by the numeral 430. These thumb wheel switches are set in accordance with each of the eight pricing or cash categories to the appropriate value. As can be seen, six of the cash categories can be programmed to have values of 0 to 99 cents, while four of them may have values of 0 to 9.99 dollars. The last two of the cash categories represent the happy hour or entertainment costs which are the same for all drinks. As can be seen, the multiplexers 1–3 are disabled when happy hour or entertainment costs are to be utilized as is indicated by the presence of an HH/E signal. This signal is applied to the most significant address of the one of ten decoder IV since, as shown, happy hour and entertainment costs are actuated by outputs 8 and 9 of the one of ten decoder IV. Selection of happy hour and entertainment costs will be discussed hereinafter.

It should now be understood that a binary input on the address lines of the one of ten decoder IV will access one of the output lines which is connected to one of the ten sets of thumb wheel switches. This accessing will raise up the thumb wheel switches in the normal manner to make contact with the lines 1, 2, 4 and 8 so as to place thereon the values of that particular cash category. So then, the multiplexers 1–3 will indicate on their output the number of times that each cash category is used in formulating a drink and the one of tem decoder IV will actuate the thumb wheel switches to evidence on the sets of output lines X, Y and Z, the value or weighted value of that particular cash category.

The outputs X, Y and Z of the thumb wheel switches are applied to the inputs of program dividers 1–3 as shown in FIG. 27. The program divider 4 receives as inputs thereto the outputs B1, B2 and B3 of the multiplexers 1–3 of FIG. 25. There is thus loaded in the program dividers 1–4 data relating to the value of a cash category and the number of times that that particular cash category was used in formulating a drink. In operation, the program dividers 1–3 are counted down from their loaded value to zero and counted into register A, comprising counters 1–3, and register B, comprising counters 4–7. The counts from the program dividers 1–3 are gated through the NAND gates 431 and 433 and the inverter 432 to the input of register A and through the NAND gate 434 to the input of register B. When the program dividers 1–3 are counted down to zero, the program divider 4 is counted down 1 from its loaded value. The program dividers 1–3 are then loaded again with the value contained on the sets of lines X, Y and Z. Again, the program dividers 1–3 are counted down to zero with the counts being entered into registers A and B. This cycle continues until the program divider 4 is counted down to zero and the program dividers 1–3 are similarly counted to zero. There is consequently stored within register A a count equivalent to the total price of the drink. The register A is reset for each individual drink dispersal so the register A will always contain a price indicia of the immediate drink being dispensed. Register B which has also received data from the program dividers 1–4 regarding the particular drink is used to add up the total price of a plurality of drinks which might be served to an individual customer. This also will become apparent hereinafter.

The outputs of register A and the outputs of register B are connected in parallel to shift registers 1 and 2. The shift registers are of the parallel load type which may receive data in parallel and transfer it serially. At the end of a drink dispersal, the data contained in register A relating to the price thereof is transferred in parallel to the shift registers 1 and 2. This data is then transferred in a serial manner through the inverter 435 to the price display described hereinabove. The register A is then reset. When a subsequent drink is sold to the same customer the program dividers 1–4 again actuate and count up registers A and B. Register B is, of course, now counted up from the position at which it was left during the last dispersal. Thus, register A contains the data regarding each individual drink while register B contains information regarding the total drinks purchased by a given customer. At the end of each individual drink, the data is shifted out of the shift registers 1 and 2 to the data display. After the total purchase by a customer, the total is shifted in parallel from register B to the shift registers 1 and 2 and then serially to the data display. The shift registers utilized are well known in the art and are of the type which may be parallel loaded or unloaded from either side (the sides of register A and register B) and may have data shifted out serially from the end as through the inverter 435.

FIG. 28 illustrates the circuitry utilized in the invention to achieve the basic clock timing required in the cash and control circuitry. As can be seen, a 100 khz pulse is applied to the clock of a J-K flip flop. The 100 khz pulse is inverted through the inverter 440 and applied to the NAND gates 441 and 442 which are respectively connected to the $\overline{Q}$ and Q outputs. Accordingly, the F and S clocks are interleaved. The Q output also produces the U/D or up/down pulse which is applied to the counters 4–7 of FIG. 27 to control the direction of count associated therewith.

As was mentioned hereinabove, and as is shown in FIG. 5, there are presented in association with the instant invention cash and credit totalizing systems. Basically these systems comprise commonly available electro-mechanical counters actuated by the application of pulses thereto. The applied required for creation of the pulses necessary to actuate the electro-mechanical counters is shown in FIG. 29. When the cash total or credit total button is depressed on the keyboard of FIG. 6, a down count signal is generated and applied through the NAND gate 434 of FIG. 27, to the register B. Under the control of the down count pulse and the U/D pulse created in FIG. 28, the register B is caused to count down from its stored value, that value being indicative of the total purchase made by a customer. The down count pulse which is applied to the register B is also applied with the $\overline{U/D}$ to the NAND gate 450 and thence to the inverter 451. The output of the inverter 451 is the count C/C signal (count cash or credit). The count C/C signal is applied to the inputs of NAND gates 452 and 453 as shown in FIG. 29. If the total credit button has been depressed on the keyboard, then a credit count signal is created by the flip flop 7–10 of FIG. 34 to be discussed hereinafter thus enabling the gate 453. The credit count signal is applied to the inverter 454 which creates the cash count signal which is applied to the gate 452. It can be seen that when a credit sale has been made, the gate 453 is enabled and the gate 452 is inhibited. Conversely, when a cash sale is made, the credit count signal is low inhibiting the gate 453 and enabling the gate 452. Thus, it will become apparent directly hereinafter that this alternate gating technique makes the actuation of a cash totalizer and credit totalizer of FIG. 5 mutually exclusive.

The outputs of the NAND gates 452 and 453 respectively connect to the clocking inputs of up/down counters 8–11 and 12–15 as shown. The direction of count of the counters is controlled by the application of the $\overline{U/D}$ signal as discussed above. As can be seen from FIG. 29, as the register B is counted down, the register CASH comprising counters 8–11 or the register CREDIT comprising counters 12–15 is correspondingly counted up depending upon which of the gates 452 or 453 is enabled. The register B is counted all the way down to zero so that at the end of the count the register CASH or the register CREDIT will have received the same number of counts as originally contained within the register B.

The registers CASH and CREDIT are utilized fundamentally as buffer registers for containing the count originally contained in the register B. As can be seen, the register B is rapidly cleared and shifted into the registers CASH and CREDIT so that the system may readily be available for the dispensing of another drink to another customer. Counting from the registers CASH and CREDIT to the remote electro-mechanical totalizers is necessarily done on a slower basis. To this end, the 50 khz U/D pulse is divided down by the three divide by ten circuits shown in FIG. 30 to produce the 50 hz signal as shown. It is this 50 hz signal which controls the transfer of data from the registers CASH and CREDIT to the respective totalizers. To this end, flip flops 456 and 457, clocked by the $\overline{50}$ pulse, respectively drive the NAND gates 458 and 459 respectively creating $\overline{CASH}$ and $\overline{CREDIT}$ signals which are applied through inverters 460 and 461 to the appropriate electro-mechanical totalizer counter. The clock pulses necessary for the down counting of the registers CASH and CREDIT are created respectively by the application of the outputs of the inverters 460 and 461 to the flip flop networks comprising flip flops 462, 463 and 464, 465, respectively. The down counting of the registers CASH and CREDIT continues until a zero count is sensed by the OR gates 470-473 or 474-477, respectively. When a zero count is reached the appropriate NAND gate, 478 or 479, resets the associated flip flop 456 or 457 thus terminating the count. Consequently, the cash or credit totalizer, remotely situated with respect to the dispensing apparatus, keeps a running total of all sales made through the dispenser. Access to the totalizers may be such as to be made only by the owner or operator of the establishment utilizing the invention.

The circuitry required for addressing the multiplexers of FIG. 26 is shown in FIG. 31. As can be seen, the outputs of an up counter are utilized for addressing the multiplexers. Happy hour (HH) and entertainment (E) inputs are shown as being applied to a NOR gate 490. These inputs are contemplated to be selectable by the operator by means of a key switch. Such switches are, of course, well known in the art. When the operator selects happy hour pricing, a 1 is presented on the input of the NOR gate 490 and consequently to the J4 input of the up counter. Similarly, the selection of entertainment pricing will result in a 1 on both the J1 and the J4 inputs of the up counter and will appropriately disable the multiplexers 1–3 and address the one of ten decoder as shown in FIG. 26. As was mentioned hereinabove, happy hour and entertainment prices are the same for all drinks and hence, cash category addressing is not required.

During normal operation, when entertainment or happy hour pricing is not in effect, the up counter is utilized for sequentially addressing the multiplexers of FIG. 26. As can be seen, the DONE pulse coming from the program divider 4 of FIG. 26, is utilized for clocking the up counter. The DONE pulse occurs at the end of the transfer of data from each cash category to the register A. Consequently, when one cash category has had its data stored in the register A, the DONE signal occurs and clocks the up counter so as to address the next most significant cash category. This continues until all 7 cash categories have been accessed. Similarly, the DONE signal is operative, through the flip flops 493 and 494, to create the LOAD signal to enable the program divider 4 of FIG. 26 to receive a new set of data corresponding to a new cash category. Of course, the first load signal is provided by means of the one frame one shot ($\overline{OFOS}$) as shown. As can be seen, when a glass is placed under the dispensing head so as to actuate the pour switch of FIG. 31, the $\overline{OFOS}$ signal actuates the initial LOAD signal to the program divider 4, of FIG. 27 and the DONE signal, emitted from the program divider 4, actuates the subsequent loading of the program dividers of FIG. 27 and addressing of the multiplexers of FIG. 26.

When the up counter of FIG. 31 has counted to the last category, the outputs Q1, Q2 and Q3 being ones, the NAND gate 492 decodes this fact and, through the NAND gate 496, sets the flip flop 498 upon receipt of the next DONE signal. The output of the NAND gate 496 also clears the up counter, setting the outputs all to zero, so as to be ready for the next drink dispersal. The output of the NAND gate 496 also passes through the inverter 497 and thus inhibits the NAND gate 495.

it should, of course, be readily apparent that the selection of happy hour or entertainment pricing will apply a reset to the flip flop 498 and a clear signal to the up counter by application of a signal through the inverter 497 and the NAND gate 496. Again, the NAND gate 495 is inhibited by application of a zero level from the output of the inverter 497. Consequently, the multiplexers are inhibited and the one of ten decoder of FIG. 26 is constantly addressed at either the happy hour or entertainment address so that the appropriate thumb wheel switches will be actuated.

The circuitry of FIG. 32 generates many of the control signals required by the cash and control and control circuitry of the invention. The signal FINI produced by the setting of the flip flop 498 of FIG. 31 is applied with the pour signal generated by the placement of a glass under the pouring head as shown in FIG. 24, to the inputs of a NAND gate 500. The resultant output of the NAND gate 500 passes through the gate 501 to the chain of flip flops 502-504, setting the first flip flop 502. The outputs of the flip flops 503 and 504 feed the NAND gate 506 thus creating the parallel/serial (P/S) signal which is applied to the shift registers of FIG. 27 for purposes of selecting parallel or serial operation. As can be seen, initially upon receipt of a POUR and FINI signal, the output of the NAND gate 506 is in the low level indicating a parallel load. This signal is passed to the shift registers 1 and 2 causing them to load data thereinto in the parallel mode. The data is loaded from the A side or the B side (register A or register B) dependent upon the state of the signal A/B emitted from the NAND gate 507 and inverter 510. As can be seen, when a total signal is not present, the output of the NAND gate 512, feeding the NAND gate 507, is at a logic 1 so as to present a 1 at the output of the inverter 510 thus signalling the shift registers 1 and 2 to accept data from the A side.

It should be apparent that when a total button on the keyboard has been pushed, either cash or credit, a logic zero is placed at the output of the NAND gate 512 and hence at one of the inputs of the NOR gate 507. The signals creating the total signal and being applied to the NAND gate 526 are created in FIG. 34 to be discussed later. In this situation, after data has been received in parallel from the A side by virtue of the application of the output of the flip flop 503 to the input of the NOR gate 507, the output of the inverter 510 will go to a logic zero thus causing the shift registers 1 and 2 to receive data from the register B. Thus it can be seen that the circuitry of FIG. 32 provides means for controlling the shift registers 1 and 2 both as to parallel or serial operation and as to the selection of data source.

Once data has been entered into the shift registers 1 and 2 as mentioned hereinabove, the shift registers will shift the data to the cash display in a serial manner. The 16 bits of data received within the shift registers 1 and 2 require 16 serial data transfer operations. To this end, a count to 10 circuit is enabled by the output of the flip flop 504 and clocked by the S clock. Upon the receipt of 10 S clocks, an output from the count to ten circuit sets the flip flop 512. The flip flop 512 feeds an input of the NAND gate 514. The other input of the NAND gate 514 is the sixth output of the count to ten circuit. Consequently, after 16 S clocks have been applied to the count to 10 circuit, the inputs of the NAND gate 514 are both at a logic one level. On the next S clock, the inverter 516 goes to a high state resetting the flip flops 498 and 504 and terminating the shift cycle. There have then been provided through the NAND gate 508 and inverter 509 to the registers 1 and 2 the 16 S clocks necessary for serially shifting the data.

It should be briefly noted that the output of the NAND gate 508 drives the display clock required for the pricing display as discussed hereinabove.

As discussed hereinabove, a down count pulse is required for application to the NAND gate 434 of FIG. 33 for purposes of counting down register B. To this end the output of flip flop 520, which is set by the flip flop 504, is supplied to the NAND gate 522, the output of which is applied through the inverter 523 to the flip flop 521. The setting of the flip flop 521 enables the NAND gate 524 to receive the S clock thus creating the down count signals. When the B register of FIG. 27 has been counted down to zero, this fact is indicated by the output signal EMPTY of the NAND gate 525 which goes to a zero level. The zero level EMPTY signal is applied to the inverter 526 which resets the flip flop 520. It is similarly applied to an input of the NAND gate 522 thus inhibiting the same. Consequently, the down counts cease when the register B has been counted down to zero.

As can be seen from many of the circuit illustrations, a signal is presented for purposes of resetting, setting or enabling certain of the circuits. This signal is labelled POP (power on and protect). This signal is created by the circuitry shown in FIG. 33. As should be readily apparent, this circuitry produces a positive going pulse on both turn on and turn off of power to the system. The positive voltage supply of the system is connected through diode controlled RC circuits to the differential inputs of an operational amplifier 530. On power turn on, a differential signal is applied to the operational amplifier 530 due to the time constant created by the capacitor 531 and resistor 532 connected to the power supply. When power is turned off, the capacitor 531 immediately discharges through the diode 533 while the capacitor 534 slowly discharges through the resistor 535. Hence, on both power turn on and power turn off, there will be a voltage differential on the inputs of the operational amplifier 530 thus resulting in a POP pulse of duration dependent upon the time constants.

As was mentioned hereinabove, row 7 of the keyboard, as shown in FIG. 6, is utilized to select the particular function to be performed. It is to be understood that if a drink is to be dispensed "on the rocks" there will be a larger dispersal of the liquor than if the liquor is to be used in a "martini." In order that a single component button may be depressed on the keyboard regardless of the type of drink in which the component is to be used, the function button 7 interrelates with the circuitry shown in FIGS. 34 and 35 to guarantee that the component will be dispersed in the proper amount corresponding to the type of drink in which it is to be used.

As can be seen in FIG. 34, data corresponding to the selection of one of the pressure actuated switches of row 7 is read from the SS RAM and is stored and decoded in an array of flip flops 7–1 through 7–16. Selectivity of the various flip flops is achieved by means of the one of ten decode IV which applies the outputs thereof to the J inputs of the flip flops 7–1 to 7–16. The addressing of the one of ten decode IV is achieved by application of the VO1-VO3 signals from the output of the binary counter of FIG. 15. Consequently, it can be seen that the one of ten decode IV selects in pairs two of the 16 flip flops in accordance with the code presented by the signal VO1-VO3.

The flip flops, having been selected in pairs by the one of ten decode IV are further selected and clocked by means of the arrangement of logic gates 550–553. As can be seen, the state of the signal VO4 selects which flip flop of the pair of flip flops accessed by the one of decode IV may be closed. The clocking of the selected flip flop is then achieved at time TC by the combination of an R7 signal and a data out signal as shown and created in the circuitry of FIG. 15. Consequently, if a button in row 7 has been depressed, signified by the presence of a data out ($D_o$) signal at the memory addressing time of that switch, the appropriate flip flop will be clocked and set.

The timing required for association with the circuitry as shown in FIG. 17 is created by the logic gates as shown in FIG. 35. The inputs to the NAND gates creating the timing signals comprise the outputs of the flip flop array of FIG. 34 as designated and the timing signals T1-T8 which are generated in the manner discussed hereinabove. As can be seen, the timing for soft drinks (SD's), cordials, creams, and standard timing function designated by 5's is shown in FIG. 35. The creation of these timing signals is straightforward and well understood by those skilled in the art and is hence not elaborated on herein. There is merely a gating together of a timing function T1-T8 with the output of the flip flop selected by actuation of a function switch in row 7. Further, timing required for the Collins, Vermouth, Prime and Wash are shown as being created in the straight-forward manner. As can be seen, two timing periods are provided for Vermouth; one time for martinis or dry manhattans and another for a regular manhatten, designated by switches and flip flops 7–4 and 7–5 respectively. Suffice it to say that the selection of the proper function switch in row 7 operatively controls the dispensing of the components selected on the remainder of the keyboard.

The signal 8–A from the output of the NAND gate 552 of FIG. 34 along with the signals 8–B through 8–G coming from the one of ten decoder IV are applied as shown in FIG. 36 to the input of NAND gates 570–575. The signal 8–A of course enables the NAND gates. The creation of the signals shown are then applied to the program board for patching to the appropriate price category for composite drinks. For instance, a drink "on the rocks" requires dispensing of more of the drink than in a composition and hence a fixed extra cost may be added. Similar pricing arrangements are made for Collins, Sour, Manhattan, Dry Martini, Martini and Soft Drinks as shown.

The circuitry shown in FIG. 37 is operative such that a current sensing resistor placed within the powerline of the solenoids is attached across the terminals 580 which feed the amplifier 581 and then to the amplifier 582. When the last component selected for the dispensing of a drink has its solenoid shut-off and current ceases to flow thereto, the termination of the flow of current through the current sensing resistor causes a signal to be emitted from the amplifier 582 to the clock of the flip flop 583 thus setting the same. Upon receipt of the $\overline{F}$ signal from the inverter 420 of FIG. 25, the flip flop 584 sets, thus resetting the flip flop 583 and resetting the flip flop 412 of FIG. 25. Hence, the system is available for a new selection and dispensing cycle. However, if the REPEAT switch on the keyboard had been depressed thus setting flip flop 7–8 then the flip flop 583 is inhibited by the signal 7–8 from setting and another dispensing of the selected drink can be made.

It should further be noted that the CLEAR switch, operative through the flip flop 7–16 is functional to set the flip flop 583 thus, by setting the flip flop 404 of FIG. 23, clearing the memory by writing all zeros thereinto if an improper button was actuated. The flip flop 404 forces the memory into the write mode and, with no buttons depressed, all zeros are written into memory, effectively clearing it. Consequently, the keyboard is prepared for receiving another selection.

As can further be seen in FIG. 36, the flip flops 585 and 586, receiving the outputs of the operational amplifiers 582 and responsive to the PNA signal from FIG. 25 and the output of the flip flop 7—7 of 33g. 39, are operative to reset the cash category counters of FIG. 25.

The flip flop 7—7 is functionally associated with the SPLASH selection switch of the keyboard. After a drink has been dispensed, with the glass still under the pouring head and engaging the pour switch, the SPLASH button may be depressed allowing a splash of a component to be dispensed into the drink for the time period T1 as indicated in FIG. 35.

As can be seen from FIG. 38, the flip flop 7–9 of FIG. 33 is operative in conjunction with the signal $\overline{F}$ to control the flip flops 590–592 to create a pulse from the output of the inverter 593 to be applied to the cash drawer control solenoid which allows the cash drawer to open when a cash sale is made as evidenced by actuation of the switch "total drawer."

Brief mention is here made of the display unit shown in FIG. 5 to be interconnected between the solenoids and the solenoid drivers. As is well known, state and federal regulations require that the type of brand of component being used in a drink be made apparent to the purchaser. To this end, an optical display unit, which may be of any suitable type, is connected to the lines interconnecting each of the solenoids and the associated driver is discussed above. Selection of the components of a drink actuate the drivers which in turn actuate the respectively associated display; the displays being of the component with which the particular solenoid is associated.

As was mentioned in reference to FIG. 2, an air solenoid 49 interacts with a plurality of dispensing solenoids 44 such that on selection of a particular drink the air solenoid 49 will pressurize the systems from which the drink is to be dispensed. There is further shown in FIG. 2 a pressure sensitive switch 68 which is actuated when a loss of pressure is realized so as to indicate to the operator that a bottle or reservoir is low or empty. The circuitry required for this operation and the circuitry required for driving the display unit 31 as shown in FIG. 1 is presented in FIG. 40. Here it can be seen that the solenoid drivers drive a plurality of pressure sensitive switches **68, 68*a* and 68*b*. When the bottles have fluid therein the switches 68 – 68*b* are in the normally closed position and hence are capable of passing signals from the solenoid drivers to the respective pour solenoids 44, 44*a* and 44*b*. As can be seen, these signals also pass through the diodes D1, D2 and D3 to the display unit 31. The display unit 31 comprises a plurality of lamps, for example L1 - L3, one lamp being associated with each of the various components of drinks selectable. The lamps are, of course, actuated by the associated solenoid driver as shown. The grounded sides of the lamps L1 - L3 are connected to ground through a time delay flasher. When a regular drink is dispensed (in for instance 5 seconds or less) the lights associated with the component stay lit during the entire dispensing cycle. If however one of the components has lost pressure in its system due to empty bottles or otherwise the same will be indicated by the associated switch 68 – 68***b*. As shown in FIG. 40 the switch 68*b* has switched to its normally open position indicating a loss of pressure has been realized. A plus voltage (+V) is then passed to the associated lamp L3 and through the time delay flasher to ground. The lamp L3 is turned on and, after a characteristic time period, the time delay flasher begins opening and closing the ground line. Consequently, the lamp L3 will have a blinking or flashing effect indicating to the operator that the associated bottles or reservoir is empty. It should of course be understood that the time delay characteristic of the flasher will be such as to exceed the maximum dispensing time for any of the drinks or components associated with this system. Thus flashing will only occur when pressure is lost and, during drink dispensing, the lights will be continuously lit. Hence, an attribute of the invention is the fact that a single lamp for each component may be utlized both for displaying the dispensing of the component and for indication of the loss of a component within the system.

It should be readily apparent that the presence of the diodes D1 - D3 guarantees that when the switches 68 - 68*b* are actuated to their normally open positions the associated pour solenoids 44 - 44*b* will not be actuated.

As was further discussed hereinabove, a single air solenoid 49 may have associated therewith a plurality of pour solenoids 44 – 44*b*. It is desirous that when any one of the pour solenoids 44 – 44*b* is actuated the air solenoid will be similarly actuated. To this end, the actuation lines for the pour solenoids 44 – 44*b* are connected respectively through diodes D4 – D6 to the air solenoid 49. As can be seen then the actuation of any combination of the pour solenoids will similarly actuate the air solenoid so as to pressurize the associated systems.

The combination of diodes D4, D5 and D6 interconnecting the actuation lines of solenoids 44, 44*a* and 44*b* with the actuation line of solenoid 49 is quite similar to that contemplated to be utilized to interconnect the syrup dispensing solenoids with the carbonated water dispensing solenoids for the soft drink dispensing capability of the system. It should readily be appreciated that if the solenoid 49 were the carbonated water solenoid and the solenoid 44, 44*a* and 44*b* were syrup solenoids then the actuation of any one of the syrup solenoids 44 – 44*b* would result in a coincident actuation of the carbonated water solenoid 49 thus resulting in the dispersal of a soft drink. Of course, the dispensing rates of the syrup solenoids 44 – 44*b* would have to be properly adjusted to be compatible with the dispensing rate of the solenoid 49. Thus, from a single dispensing head, the simultaneous pouring of two components may be achieved to rapidly dispense a composite drink.

As should now be apparent, an important attribute of the instant invention is the speed with which drinks may be dispensed. In keeping with the speed requirement of the system, provisions have been made whereby two dispensing lines may simultaneously dispense the same component thus substantially reducing the time for dispensing the aggregate of that component necessary in a mixed drink. Such a provision is shown in FIG. 39. As can be seen in this Figure, the reservoir 89 receives through the boss portion 91 two dispensing lines 76, 76*a* through respective bores 92, 92. Assuming, for purposes of presentation, that the reservoir 89 contains a sour, it should be understood that regulation of the dispensing of the sour through the lines 76, 76*a* is controlled by means of actuation of the solenoids S2, S1 respectively. As is well known, a "sour" drink requires the dispensing of one ounce of the sour mix. On the other hand, a "collins" drink may require the dispensing of four ounces of the sour mix. If it is desired to dispense the total four ounces of the sour mix for a collins drink within a one second time interval, it has been found that a splashing of the mix occurs from the rapid dispensing thereof into the drink glass. Since this is an undesirable condition, the arrangement of FIG. 39 has been provided so that, in dispensing a collins, the dispensing of the sour mix may be through two lines simultaneously.

It should be readily apparent from FIG. 39 that actuation of the sour solenoid driver (by selection of the sour button on the keyboard) actuates the solenoid S2 for the predetermined period of time, for example one second. Consequently there is one ounce of sour mix dispensed through the lines 76 in the one second time interval. If the collins button is actuated on the keyboard then the collins solenoid driver actuates the solenoid S1 and, through the diode D, the solenoid S2. If the solenoid valve S1 is of such nature as to dispense three ounces of fluid within a one second time interval then it should be readily apparent that, upon actuation of the collins solenoid driver, one ounce of sour mix will be dispensed through the line 76 and three ounces will be dispensed through the line 76*a*; all dispensing being done within the one second time interval. Of course, the solenoid valves S1 and S2 are of the type well known in the art which are manually adjustable to regulate the rate of dispensing therethrough. The solenoid S1 is adjusted to dispense at three times the rate of the solenoid S2 so that the solenoid S2 may be utilized in the dual capacity of dispensing both the sour and the collins.

The apparatus of FIG. 39 thus allows the rapid dispensing of a drink requiring a large quantity of a particular mix in a short time period. The dispensing function is divided between two dispensing lines such that the splashing effect characteristic of a large-volume short-time dispersal through a single line is alleviated.

It should be readily apparent that the apparatus described herein need not be limited to the utilization for mixing alcoholic beverages but indeed could be utilized for the formulation of any composition of fluids or other substances. Adaptation of this system and technique is contemplated for use in hospitals for the dispensing of baby formulas and the like. Many other uses and adaptations should also be readily apparent.

What is claimed is:

1. An automatic drink dispensing apparatus, comprising:

operator actuatable selection means for selecting the ingredients or compositions to be dispensed;

a plurality of first receptacles for maintaining a reservoir of ingredients therein under atmospheric pressure;

a plurality of second receptacles in communication with the first receptacles through a first valve at a first end thereof and in communication with a source of pressurization through a second valve at a second end thereof;

flow lines connected to said second receptacles and having valve means interposed therein for regulating the flow of ingredients being dispensed; and valve control means interconnected between the valve means and said second valve to regulate the application of pressure to said second receptacles and the subsequent dispensing of ingredients therefrom.

2. The automatic drink dispensing apparatus as recited in claim 1 wherein said second receptacles are funnel shaped at said first end thereof and defining a valve seat at the lowermost point thereof and said first valve comprises a spherical member in fluid passing and sealing engagement with said seat.

3. The automatic drink dispensing apparatus as recited in claim 2 wherein said spherical member is a hollow stainless steel ball.

4. The automatic drink dispensing apparatus as recited in claim 1 wherein said first receptacle has means at an upper end thereof for receiving an inverted fluid-containing bottle, the bottle communicating with the first receptacle to maintain a reservoir of fluid within said first receptacle.

5. The automatic drink dispensing apparatus as recited in claim 1 wherein said valve means comprises solenoid actuated valves having manually adjustable flow rates.

6. The automatic drink dispensing apparatus as recited in claim 1 wherein said second valve and said valve means are interconnected with and under the control of the selection means to sequentially pressurize said second receptacles, dispense fluid from said second receptacles, and then release pressure therefrom.

7. The automatic drink dispensing apparatus as recited in claim 6 wherein said second valve includes an exhaust port for depressurizing said second receptacle subsequent to dispensing.

8. The automatic drink dispensing apparatus as recited in claim 1 which further includes low level indicating switches interposed between the first and second receptacles for indicating when the level of fluid in the associated first receptacle is below a particular level.

9. The automatic drink dispensing apparatus as recited in claim 1 wherein said flow lines comprise flexible tubing.

10. The automatic drink dispensing apparatus as recited in claim 1 wherein said first valve isolates said first receptacles from the source of pressurization.

11. The automatic drink dispensing apparatus as recited in claim 10 wherein said first receptacles are vented to the atmosphere.

12. The automatic drink dispensing apparatus as recited in claim 1 which is further characterized by the presence of means to visually display and identify the ingredients being dispensed for the duration of the period that the same are being dispensed.

13. The automatic drink dispensing apparatus as recited in claim 1 which further includes means for visually displaying the price of the drink being dispensed following the initialization of such dispensing.

14. An apparatus for dispensing a composition of fluids, comprising:

operator actuatable selection means for selecting the composition to be dispensed;

a plurality of receptacles for retaining a reservoir of the fluids therein;

a plurality of tubes, at least one connected to each of the plurality of receptacles, for dispensing said fluid, each of said tubes having connected thereto valve means operatively connected to said selection means for regulating fluid flow through the tubes;

a rigid sleeve encompassing said tubes in parallel side by side relationship; and a sub-pouring head located within said sleeve and enveloping certain of said tubes.

15. The apparatus as recited in claim 14 wherein said sub-pouring head depends below the ends of the remaining tubes encompassed by said rigid sleeve.

16. The apparatus as recited in claim 15 wherein the ends of certain of the tubes of said sub-pouring head are deflected towards the center thereof.

17. The apparatus as recited in claim 14 wherein the tubes, at the area of encasement by the rigid sleeve, are of smaller diameter than the remaining portion of said tubes.

18. Apparatus for dispensing a composition of fluids in accordance with the selected formulation, comprising:

a keyboard of selector switches, each switch having associated therewith a particular component, composition, or function to be performed by the dispensing apparatus;

a memory array operatively connected to the keyboard and having a plurality of data storage positions, one position for each of the selector switches, the position storing data therein indicative of the state of actuation of the associated switch;

indicating means, associated with the switches of the keyboard, connected to the memory array and operative to produce an indicia of the fact that data indicating actuation of the switch has been stored in memory;

first means operatively connected to the memory array for simultaneously dispensing the components and proportions of each as selected from the keyboard; and second means connected to the first means for tallying indicia regarding the components and amounts thereof utilized in the formulation of the composition.

19. The apparatus as recited in claim 18 wherein the first means includes decoding means interconnected among the first means, the addressing means, and the memory array, the decoding means applying signals to the second means to cause the dispensing of components therefrom.

20. The apparatus as recited in claim 18 which includes addressing means connected to the memory, the switches, and the indicating means for serially addressing all of the switches, and simultaneous with the addressing of the switches, addressing the associated storage positions in memory and the associated indicating means.

21. The apparatus as recited in claim 18 wherein the first means includes a carbonated water dispensing reservoir and a plurality of soft drink syrup reservoirs, each reservoir having a solenoid actuated dispensing valve connected thereto, each valve for the syrup reservoirs having an actuation circuit connected thereto and the valve for the carbonated water being operatively connected to the actuation circuits of all of the syrup valves.

22. Apparatus for dispensing a composition of fluids in accordance with a preselected formulation, comprising:

first means for selecting the particular components to be utilized in the formulation of the composition;

a plurality of solenoids, one for each of the components selectable, operative to enable or inhibit the dispensing of the associated components;

a plurality of timing circuits comprising selector switches interconnected between latch means and oscillator decode dividing means;

logic gates receiving the outputs of the timing circuit and the first means and operative to accordingly control the excitation of the solenoids; and second means connected to the first means for tallying indicia regarding the components and amounts thereof utilized in the formulation of the composition.

23. The apparatus as recited in claim 22 which further includes solenoid drivers interposed between the logic gates and the solenoids, the logic gates emitting short duration pulses for actuation of the solenoid and the solenoid drivers including means for converting the pulses into a D.C. level of sufficient amplitude to actuate the solenoid.

24. The apparatus as recited in claim 22 wherein all outputs of the latching means are simultaneously initialized to a logic state and progressively change state at times corresponding to the length of time designated by the associated selector switch.

25. The apparatus as recited in claim 22 wherein the first means comprises a plurality of manually actuatable selector means having weighted values associated therewith, the second means comprises circuit means producing output signals indicative of which selector means have been actuated and counters connected to the circuit means and responsive to the output signals thereof to count the number of selector means of each weighted value which have been actuated.

26. The apparatus as recited in claim 25 which includes value selection means operatively connected to the counters, at least one such value selection means for each of the various weighted values attributed to the selector means and each said value selection means being adjustable by the operator.

27. The apparatus as recited in claim 26 which includes a first register operatively interconnected between the counters and their associated value selection means, the first register receiving and storing data corresponding to the aggregate of the weighted values of all the actuated selector means for a singular dispersal.

28. The apparatus as recited in claim 27 which includes a second register operatively interconnected between the counters and their associated value selection means, the second register receiving and storing data corresponding to the aggregate of the weighted values of all the actuated selector means for a plurality of dispersals.

29. The apparatus as recited in claim 28 which includes shifting means interconnected between the first and second registers and operative to receive the stored data from each of the two registers.

30. The apparatus as recited in claim 29 which further includes display means connected to the shifting means for visually displaying indicia of the data stored in the first register at the end of each dispersal.

31. The apparatus as recited in claim 30 wherein the display means is two sided and comprises back-to-back liquid crystal displays producing visual outputs on each of the two sides thereof.

32. Apparatus for dispensing a composition of fluids in accordance with a selective formulation, comprising:

first means for selecting the particular components to be utilized in the formulation of the composition;

second means connected to the first means for simultaneously dispensing the components and proportions of each as selected by the first means;

third means connected to the first and second means for tallying indicia regarding the components and amounts thereof utilized in the formulation of the composition; and wherein the second means includes a fluid dispensing reservoir having two dispensing solenoids connected thereto, a first dispensing solenoid responsive to the first means to dispense a first quantity of the fluid from the reservoir and a second dispensing solenoid responsive to the first means to dispense a second quantity of the fluid from the reservoir, the two solenoids being interconnected such that the first solenoid may dispense independently of the second but the second can only dispense concurrently with the first.

33. Apparatus for dispensing a fluid or composition of a plurality of fluids according to an operator selectable formulation, comprising:

a plurality of operator actuatable switches for allowing the operator to select the particular components to be dispersed;

dispersing means connected to the component selection means for both simultaneously initiating and controlling the dispersing of all components selected by the operator;

programming means interconnected between the switches and the dispersing means for allowing the operator to physically interconnect the switches and dispersing means such that selection of a single switch will effectuate the dispersing of a particular formulation; and timing means connected to the dispersing means for regulating the quantity of each component dispersed.

34. The apparatus as recited in claim 33 wherein the programming means comprises a plurality of logic circuits having patch pin inputs from the component selection means and timing means and patch pin outputs to the dispensing means.

35. The apparatus as recited in claim 34 which further includes pricing means having patch pin inputs connected to the patch pin outputs of the logic circuits.

36. The apparatus as recited in claim 33 wherein the timing meas includes a clock generator driving a decode circuit, the decode circuit being connected to a plurality of rotary switches, the outputs of the rotary switches sequentially setting each of a plurality of flip flops to create timing signals.

37. Apparatus for dispensing a fluid or composition of a plurality of fluids according to an operator selectable formulation, comprising:

component selection means for allowing the operator to select the particular components to be dispersed;

dispersing means including at least two solenoid dispensing valves operative to dispense the same fluid, the valves being operatively connected such that the first one of the valves may be actuated independently of the second but the second one of the valves can only be actuated simultaneously with the first; and timing means connected to the dispersing means for regulating the quantity of each component dispersed.

38. Apparatus for dispensing a composition of fluids in accordance with a selected formulation, comprising:

a plurality of manually actuatable selection means having weighted values associated therewith for selecting the particular components to be utilized in the formulation of the composition;

second means connected to the selection means for simultaneously dispensing the components in proportions of each as selected by the selection means;

counters connected to the second means and responsive to output signals thereof to count the number of dispersals of each weighted value;

first and second registers operatively connected to the counters, the first register receiving and storing data indicative of the aggregate of weighted values of all actuated selector means for a single dispersal and the second register receiving and storing data indicative of the aggregate of weighted values of all actuated selector means for a plurality of dispersals;

shifting means connected to the first and second registers and receiving data therefrom; and two totalizer counters connected to the shifting means and mutually exclusively receiving data thereinto from the second register.

39. Apparatus for dispensing a fluid or composition of a plurality of fluids according to an operator selectable formulation, comprising:

component selection means for allowing the operator to sequentially select the particular fluid components to be dispersed;

dispersing means connected to the component selection means for both initiating and controlling a simultaneous dispersing of all fluid components sequentially selected by the operator; and function selection means interconnected with the component selection means for allowing the operator to select the type of drink in which the selected fluid components will be used, said function selection means being operative to regulate the quantity dispensed of the various fluid components selected.

40. The apparatus as recited in claim 39 which further includes pricing means interconnected between the component selection means, function selection means, and the dispensing means for registering the price of each fluid or composition of fluids dispensed, said price being dependent upon the components and function selected.

41. The apparatus as recited in claim 40 wherein the pricing means comprises a plurality of counters interconnected with a programmable value fixing means for attributing to each of the counters a particular price, each counter counting the number of components or functions of the associated price utilized in the fluid or composition dispensed.

42. The apparatus as recited in claim 41 which further includes first and second price summing means connected to the counter and value fixing means, the first summing means totalizing the price for all components utilized in a single dispersal and the second summing means totalizing the totals tallied by the first summing means for a number of dispersals selected by the operator.

43. The apparatus as recited in claim 42 which further includes cash and credit totalizers connected to the second summing means for keeping a running total of the prices of all dispersals made for cash and all dispersals made for credit respectively.

44. The apparatus as recited in claim 43 which includes a cash drawer actuation means for enabling the cash totalizer to receive price data from the second summing means and for simultaneously unlocking a cash drawer to allow access thereto.

45. The apparatus as recited in claim 40 which further includes single price selection means associated with the pricing means and actuated by the operator for attributing a single fixed price to all fluids or compositions of fluids dispensed, that price being independent of the fluid or composition dispensed.

46. The apparatus as recited in claim 39 which further includes component display means connected to the dispensing means for producing indicia of the components being dispensed and the capability of the apparatus to dispense each of the available components.

47. The apparatus as recited in claim 46 wherein the display means comprises a single filament lamp for each available component and wherein each lamp is operative to indicate both the dispensing of the associated component and the capability of the apparatus to dispense such component.

48. Apparatus for dispensing a composition of fluids in accordance with a selective formulation, comprising:

a plurality of manually actuatable selector means having weighted values associated therewith;

circuit means producing output signals indicative of which selector means have been actuated;

counters connected to said circuit means and responsive to the output signals thereof to count the number of selector means of each weighted value which have been actuated;

value selection means connected to the counters for attributing to the counters the appropriate weighted values; and fixed value selection means connected to the value selection means and the counters and operative to inhibit the counters and enable but a single weighted value of the selected means.

49. Apparatus for dispensing a composition of fluids in accordance with a selected formulation, comprising:

a plurality of selection means, one associated with each of the particular compositions of fluids, for selecting the dispensing of the associated compositions;

a plurality of timing circuits interconnected between solenoid valves and the selection means for simultaneously dispensing the components and proportions of each as selected from the selection means; and a patchboard having a plurality of logic circuits and means for interconnecting the solenoids, timing circuits and logic circuits for preprogramming the various compositions.

50. The apparatus as recited in claim 49 which further includes value indication means for selective interconnection with the logic circuits of the patchboard for associating a particular value with each of the various combinations.

51. A liquid dispensing unit comprising:

A. a first reservoir associated with a fluid source;

B. a second reservoir connected with said first reservoir and having a conically shaped wall with a central opening therein for fluid communication with said first reservoir and wherein a ball is received in said second reservoir in self aligning closing relationship with said central opening and being adapted 1. to permit fluid flow from said first reservoir to said second reservoir in measured amounts, and
2. to prevent return of said measured amounts from said second reservoir to said first reservoir;

C. a discharge opening associated with said second reservoir downstream of said ball and central opening and being movable between open and closed positions; and D. pressure means associated with said second reservoir and being adapted to urge said measured amounts through said discharge opening under pressure when said opening is in said open position.

52. The unit of claim 51 further characterized by the fact that said second reservoir is vented to atmosphere except during operation of said pressure means.

53. Apparatus for dispensing a fluid or composition of fluids as selected by an operator, comprising:

component selection means for allowing an operator to select the fluids to be dispensed;

timing period generation means for producing signals of various time period durations;

function selection means interconnected with the time pulse generation means for providing time pulses;

dispensing means interconnected between the component selection means and function selection means for dispensing quantities of the fluids selected by the selection means as determined by the actuation of the function selection means; and wherein the component and function selection means comprise a plurality of operator actuatable selection switches and solid state data storage elements for receiving and storing data indicative of a state of actuation of the selector switches.

54. The apparatus for dispensing a fluid or composition of fluids as recited in claim 53 wherein the function selection means further includes logic circuit means interconnected between the storage elements and timing period generation means for creating said timing pulses according to the state of actuation of said selector switches and component selection means.

55. The apparatus for dispensing a fluid or composition of fluids as recited in claim 53 wherein said function selection means comprises a plurality of operator actuatable selector switches and which further includes pricing means connected to said component selection means and said function selection means for determining an aggregate price based on the fluid selected by the component selection means and the state of actuation of the operator actuatable selector switches.

* * * * *